US008893214B2

(12) United States Patent
Kitazato et al.

(10) Patent No.: US 8,893,214 B2
(45) Date of Patent: Nov. 18, 2014

(54) IMAGE PROCESSING APPARATUS, SIGNAL PROCESSING METHOD, AND PROGRAM

(75) Inventors: Naohisa Kitazato, Tokyo (JP); Izumi Hatakeyama, Tokyo (JP); Masayuki Obayashi, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 13/237,468

(22) Filed: Sep. 20, 2011

(65) Prior Publication Data

US 2012/0300130 A1 Nov. 29, 2012

(51) Int. Cl.
*H04H 60/43* (2008.01)

(52) U.S. Cl.
CPC ..... *H04H 60/43* (2013.01)
USPC ..... 725/149; 725/148

(58) Field of Classification Search
CPC ..... H04H 60/43; H04N 7/173
USPC ..... 725/149
See application file for complete search history.

(56) References Cited

U.S. PATENT DOCUMENTS

| | | | | |
|---|---|---|---|---|
| 2006/0205396 | A1* | 9/2006 | Laroia et al. | 455/422.1 |
| 2007/0159969 | A1* | 7/2007 | Das et al. | 370/229 |
| 2009/0054021 | A1* | 2/2009 | Okada et al. | 455/131 |
| 2009/0154615 | A1* | 6/2009 | Hijikata et al. | 375/344 |
| 2009/0235314 | A1* | 9/2009 | Mito et al. | 725/50 |
| 2009/0285318 | A1* | 11/2009 | Adachi | 375/260 |

FOREIGN PATENT DOCUMENTS

| | | | |
|---|---|---|---|
| JP | 2007-329847 | 12/2007 | |
| WO | WO 2008-143185 | 11/2008 | |
| WO | WO 2008143181 A1 * | 11/2008 | H04H 60/43 |

OTHER PUBLICATIONS

Toru Kuroda, "1 Seg towa Chigau 'digital radio' Shorai wa Multimedia Hoso ni Hatten e", Nikkei Electronics, Jan. 14, 2008, No. 969, pp. 126 to 136.
Masataka Sumikura, "1 seg systems (final) Looking at communications and broadcasting related examples", Nikkei Electronics, Sep. 24, 2007, No. 961, pp. 205 to 213.
Yoshikazu Narikiyo, "2. The Latest Technological Trend in ISDB-T One-Seg Services, 2-3. One-Seg combined Re-transmission System", The Journal of the Institute of Image Information and Television Engineers, May 1, 2008, vol. 62, No. 5, pp. 662 to 665.
Tomoyuki Okamura , "5. Frequency plan after analog TV, 5-1. Multi-Media Broadcasting "ISDB-Tmm"", The Journal of the Institute of Image Information and Television Engineers, May 1, 2008, vol. 62, No. 5, pp. 692 to 695.

* cited by examiner

*Primary Examiner* — Jefferey Harold
*Assistant Examiner* — Justin Sanders
(74) *Attorney, Agent, or Firm* — Sherr & Jiang, PLLC

(57) ABSTRACT

The present invention relates to a transmitting apparatus and method and a receiving apparatus and method that allow obtaining of all of the tuning information of a multi-segment broadcasting. A signal converter 43 generates an NIT of the center segment of a One-Seg rebroadcasting including tuning information that is information on tuning to the center segment of the One-Seg rebroadcasting and multi-segment information indicating that the center segment is a segment of the multi-segment broadcasting. A multi-segment transmitter 44 transmits an NIT of the center segment of the One-Seg rebroadcasting in the center segment. The invention is applicable to, for example, a broadcasting station that transmits a multi-segment broadcasting in a terrestrial digital broadcasting wave.

20 Claims, 31 Drawing Sheets

FIG.11

```
· multi_segment_info_descriptor(){
   descriptor_tag                    8
   descriptor_length                 8
   multi_segment_mode                4
  reserved                           4
   for(i=0;i<N;i++){
     multi_segment_bitmap               16×N
   }
  }
```

```
· one_seg_redistribution_info_descriptor() {
   descriptor_tag                          8
   descriptor_length                       8
   no_of_ts                                8
   for(i=0;i<N;i++) {
     terrestrial_network_id                16×N
   }
  }
```

IMAGE PROCESSING APPARATUS, SIGNAL PROCESSING METHOD, AND PROGRAM

TECHNICAL FIELD

The present invention relates to a transmitting apparatus and method and a receiving apparatus and method. More particularly, the present invention relates to a transmitting apparatus and method and a receiving apparatus and method that allow obtaining of all of the tuning information of a multi-segment broadcasting.

BACKGROUND ART

Recently, terrestrial digital broadcasting has been started in Ultra High Frequency (UHF) band. Each physical channel of a terrestrial digital broadcasting is divided into 13 segments, one segment of which is used for broadcasting for mobile terminals. Then, the remaining 12 segments are used together for broadcasting for fixed terminals, such as television receivers (for example, see Patent Document 1).

Currently, in broadcasting for mobile terminals, the same content as that of broadcasting for fixed terminals is broadcast. Mobile terminals, mainly mobile phones, capable of receiving a broadcasting for mobile terminals have already been widely spread.

Also, in a terrestrial digital broadcasting wave, channels 13 to 52 of UHF band include many unused channels in addition to channels in which terrestrial digital broadcasting is actually performed in various regions. So, a method for effectively utilizing these unused channels is under consideration.

One possible method for effectively utilizing the unused channels is to perform multi-segment broadcasting in the unused channels. Note that multi-segment broadcasting refers to a plurality of one-segment broadcastings simultaneously transmitted in one physical channel. In other words, multi-segment broadcasting refers to broadcasting in which the frequency band of terrestrial digital broadcasting is divided into a plurality of segments and one or more broadcasting services are performed in one segment.

By the way, a conventional mobile terminal for receiving broadcasting for mobile terminals obtains tuning information that is information on tuning, such as frequency, and creates a table of tuning information (hereinafter referred to as tuning table) as follows:

FIG. 1 is a flowchart of tuning table creation by a conventional mobile terminal.

In step S11, the mobile terminal sets a predetermined physical channel (for example, a physical channel with the lowest frequency) as target physical channel to be processed. In step S12, the mobile terminal tunes to the center segment of the target physical channel. In step S13, the mobile terminal determines whether the Transport Stream (TS) of the center segment of the target physical channel has been received or not. If determined that it has been received, the process proceeds to step S14.

In step S14, the mobile terminal obtains, from the received TS, an Network Information Table (NIT) that is information on the network of the segment for the mobile terminal, described as NIT actual, and an Service Description Table (SDT) that is information on the broadcasting service of the network of the segment for the mobile terminal, described as SDT actual. Note that the NIT refers to a table that contains frequency information for each broadcasting service and information on the corresponding broadcasting service for tuning the carrier frequency to a certain broadcasting service. Furthermore, the SDT refers to a table that contains meta-information for each broadcasting service (for example, service name and the like). After the processing in step S14, the process proceeds to step S15.

On the other hand, if determined in step S13 that the TS of the center segment has not been received, the process skips step S14 and proceeds to step S15.

In step S15, the mobile terminal determines whether all of the physical channels have been set as target physical channel or not. If determined in step S15 that not all of the physical channels have been set as target physical channel, in step S16, the mobile terminal sets a next physical channel (for example, a physical channel with the second lowest frequency) as target physical channel, then the process returns to step S12. Then, the mobile terminal repeats the process of steps S12 to S16 until all of the physical channels are set as target physical channel.

On the other hand, if determined in step S15 that all of the physical channels have been set as target physical channel, in step S17, the mobile terminal creates a tuning table based on the NITs and SDTs obtained in step S14.

Specifically, as shown in FIG. 2, the NIT contains a network ID that is an ID unique to a network, a TSID that is an ID unique to a TS, a frequency, a service ID unique to a broadcasting service and the like, corresponding to the segment for the mobile terminal. Furthermore, the SDT contains meta-information on a broadcasting service corresponding to the segment for the mobile terminal, including a TSID, a service ID, a service name and the like, of the broadcasting service.

Thus, as shown in FIG. 2, the mobile terminal obtains the service ID and the frequency as tuning information from the NIT of the center segment of each physical channel, obtains the service name from the SDT corresponding to the NIT, then associates the service name with the frequency to create the tuning table.

Note that, in the example shown in FIG. 2, since two broadcasting services are broadcast in a time-division manner in the center segment of a physical channel 1 (PhCH-1), two service IDs are contained in the NIT of the center segment of the physical channel 1.

PRIOR ART DOCUMENT

Patent Document

Patent Document 1: JP-A-2007-329847

SUMMARY OF THE INVENTION

Problems to be Solved by the Invention

As above, the conventional mobile terminal scans the TS of the center segment of each physical channel and obtains tuning information from the NIT of the segment for the mobile terminal contained in the TS.

So, when multi-segment broadcasting is performed in an unused channel, the tuning information of the center segment 11 of the unused channel can be obtained, but the tuning information of segments 12-1 to 12-6 other than the center segment 11 cannot be obtained, as shown in FIG. 3.

In view of the above, the present invention is intended to allow all of the tuning information of multi-segment broadcasting to be obtained.

Means for Solving the Problems

A transmitting apparatus in accordance with a first aspect of the invention includes: generating means for generating representative tuning information including tuning information that is information on tuning to a representative segment of a multi-segment broadcasting and multi-segment information indicating that the representative segment is a segment of the multi-segment broadcasting; and transmitting means for transmitting the representative tuning information in the representative segment.

A transmitting method in accordance with the first aspect of the invention includes: generating step in which a transmitting apparatus generates representative tuning information including tuning information that is information on tuning to a representative segment of a multi-segment broadcasting and multi-segment information indicating that the representative segment is a segment of the multi-segment broadcasting; and transmitting step in which the transmitting apparatus transmits the representative tuning information in the representative segment.

In the first aspect of the invention, representative tuning information including tuning information that is information on tuning to a representative segment of a multi-segment broadcasting and multi-segment information indicating that the representative segment is a segment of the multi-segment broadcasting is generated, and the representative tuning information is transmitted in the representative segment.

A receiving apparatus in accordance with a second aspect of the invention includes: receiving means for receiving representative tuning information including tuning information that is information on tuning to a representative segment and multi-segment information indicating that the representative segment is a segment of a multi-segment broadcasting, transmitted in the representative segment of the multi-segment broadcasting; and controlling means for controlling tuning depending on the multi-segment information included in the representative tuning information received by the receiving means.

A receiving method in accordance with the second aspect of the invention includes: receiving step in which a receiving apparatus receives representative tuning information including tuning information that is information on tuning to a representative segment and multi-segment information indicating that the representative segment is a segment of a multi-segment broadcasting, transmitted in the representative segment of the multi-segment broadcasting; and controlling step in which the receiving apparatus controls tuning depending on the multi-segment information included in the representative tuning information received in the receiving step.

In the second aspect of the invention, representative tuning information including tuning information that is information on tuning to a representative segment and multi-segment information indicating that the representative segment is a segment of a multi-segment broadcasting, transmitted in the representative segment of the multi-segment broadcasting, is received, and tuning is controlled depending on the multi-segment information included in the representative tuning information.

Advantage of the Invention

As above, according to the first aspect of the invention, the tuning information of the representative segment of the multi-segment broadcasting and the multi-segment information indicating that the representative segment is a segment of the multi-segment broadcasting can be transmitted in the representative segment. As a result, all of the tuning information of the multi-segment broadcasting can be obtained by the receiving side of the multi-segment broadcasting.

According to the second aspect of the invention, all of the tuning information of the multi-segment broadcasting can be obtained.

BRIEF DESCRIPTION OF THE DRAWINGS

FIG. 11 A description example of a multi-segment information descriptor.

MODE FOR CARRYING OUT THE INVENTION

First Embodiment

Configuration Example of First Embodiment of Transmitting/Receiving System

Figure 1:
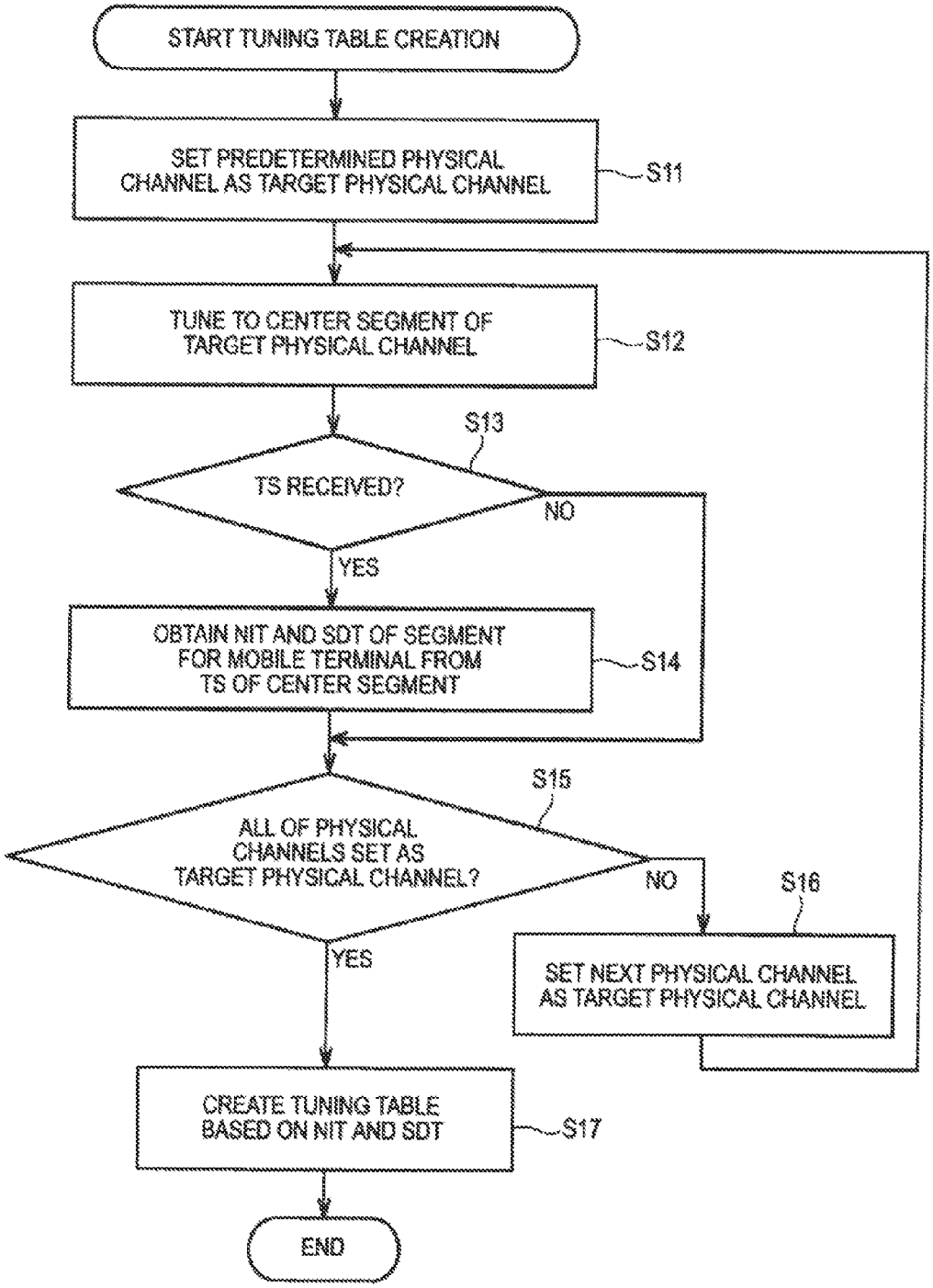
FIG.1 RELATED ART
FIG. 1 A flowchart of tuning table creation by a conventional mobile terminal.
Figure 2:
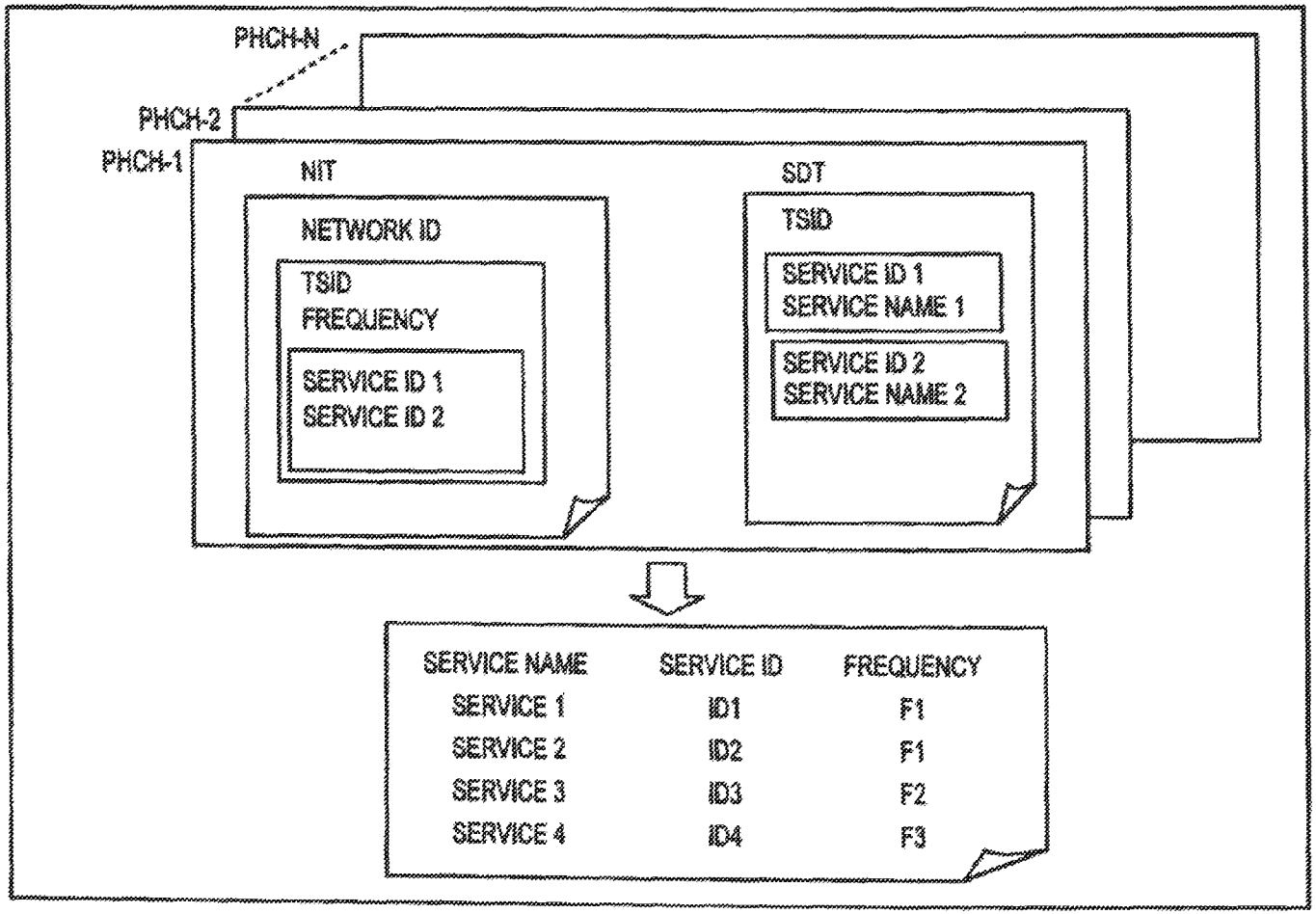
FIG. 2 RELATED ART
FIG. 2 An example of a tuning table.
Figure 3:
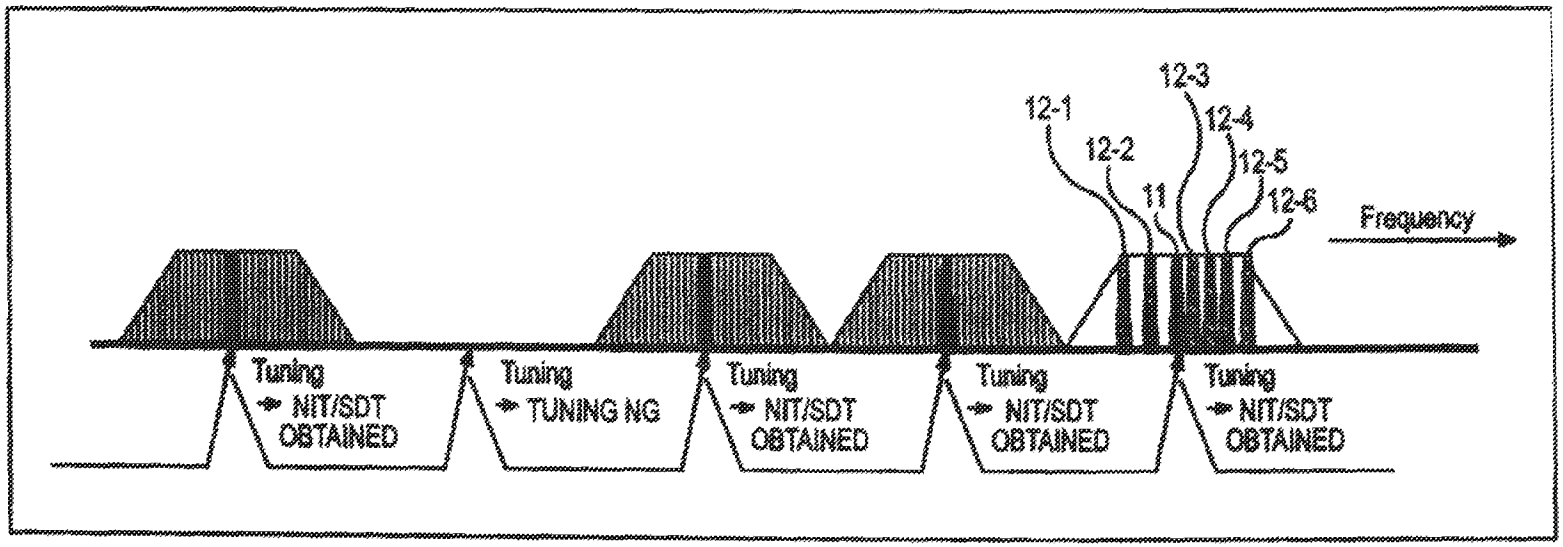
FIG. 3 RELATED ART
FIG. 3 An illustration of tuning information that can be obtained by the conventional mobile terminal.
Figure 4:
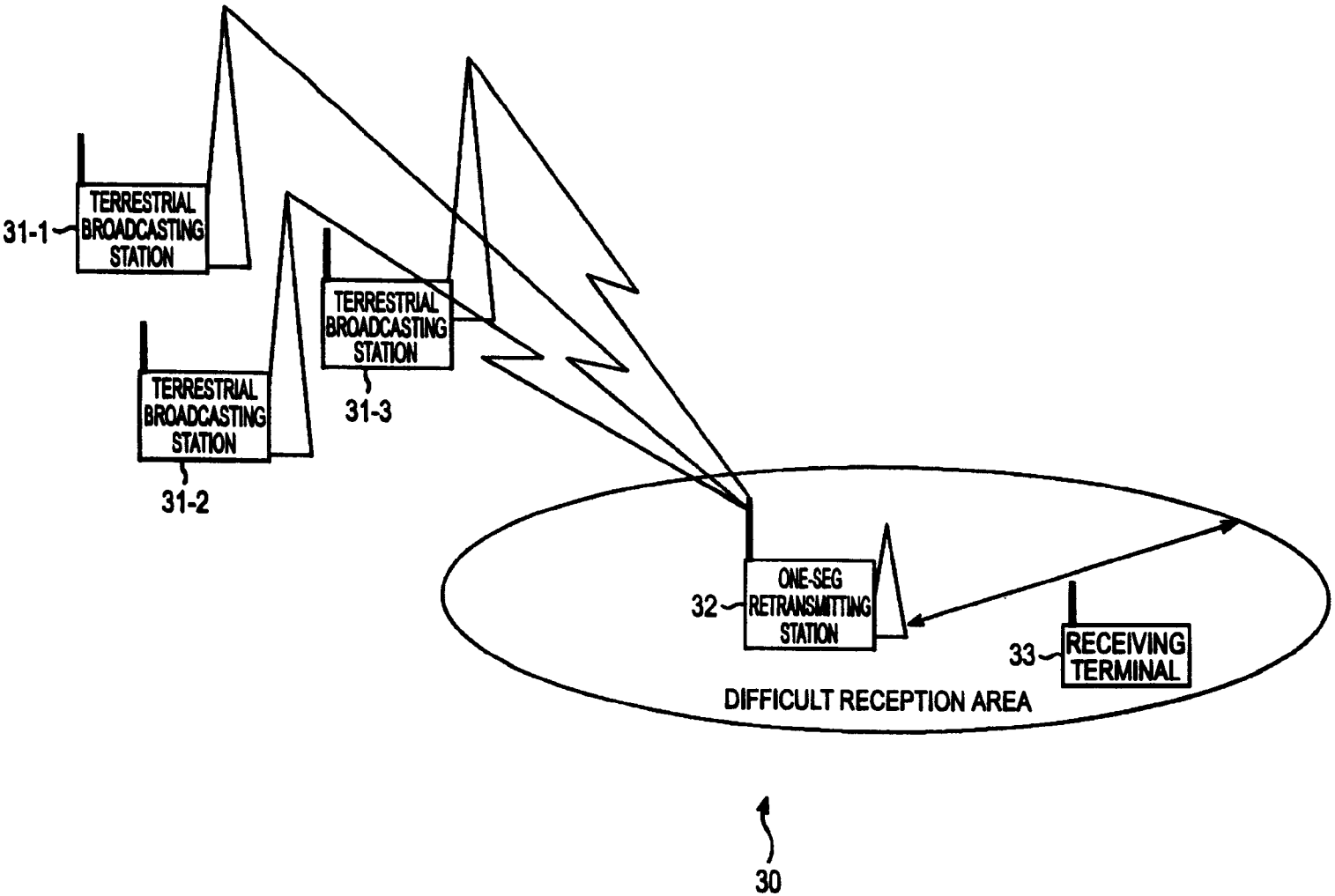
FIG. 4 A configuration example of a first embodiment of a transmitting/receiving system to which the invention is applied.

FIG. 4 shows a configuration example of a first embodiment of a transmitting/receiving system to which the invention is applied.

A transmitting/receiving system 30 in FIG. 4 includes terrestrial broadcasting stations 31-1 to 31-3, a One-Seg retransmitting station 32 and a receiving terminal 33.

The terrestrial broadcasting stations 31-1 to 31-3 perform terrestrial digital broadcasting using a terrestrial digital broadcasting wave. Note that, hereinafter, the terrestrial broadcasting stations 31-1 to 31-3 are collectively referred to as a terrestrial broadcasting station 31 when they need not be individually distinguished.

The One-Seg retransmitting station 32 receives a broadcasting for mobile terminals of terrestrial digital broadcasting (hereinafter referred to as One-Seg broadcasting) transmitted from the terrestrial broadcasting station 31. Then, the One-Seg retransmitting station 32 retransmits the One-Seg broadcasting in a multi-segment broadcasting to a difficult reception area using an unused channel of the terrestrial digital broadcasting wave. Note that the difficult reception area refers to an area, such as a underground mall, in which it is difficult to receive terrestrial digital broadcasting transmitted from the terrestrial broadcasting station 31.

The receiving terminal 33 is a mobile terminal capable of receiving a One-Seg broadcasting transmitted from the terrestrial broadcasting station 31 and a One-Seg broadcasting retransmitted in the multi-segment broadcasting from the One-Seg retransmitting station 32. Hereinafter, the One-Seg broadcasting transmitted from the One-Seg retransmitting station 32 is referred to as One-Seg rebroadcasting.

As above, since the One-Seg retransmitting station 32 retransmits the One-Seg broadcasting to the difficult reception area, the receiving terminal 33 can reliably receive the One-Seg broadcasting even in the difficult reception area. Now, One-Seg broadcasting is described as an example of multi-segment broadcasting.

[Description of Terrestrial Digital Broadcasting Wave]

Figure 5:
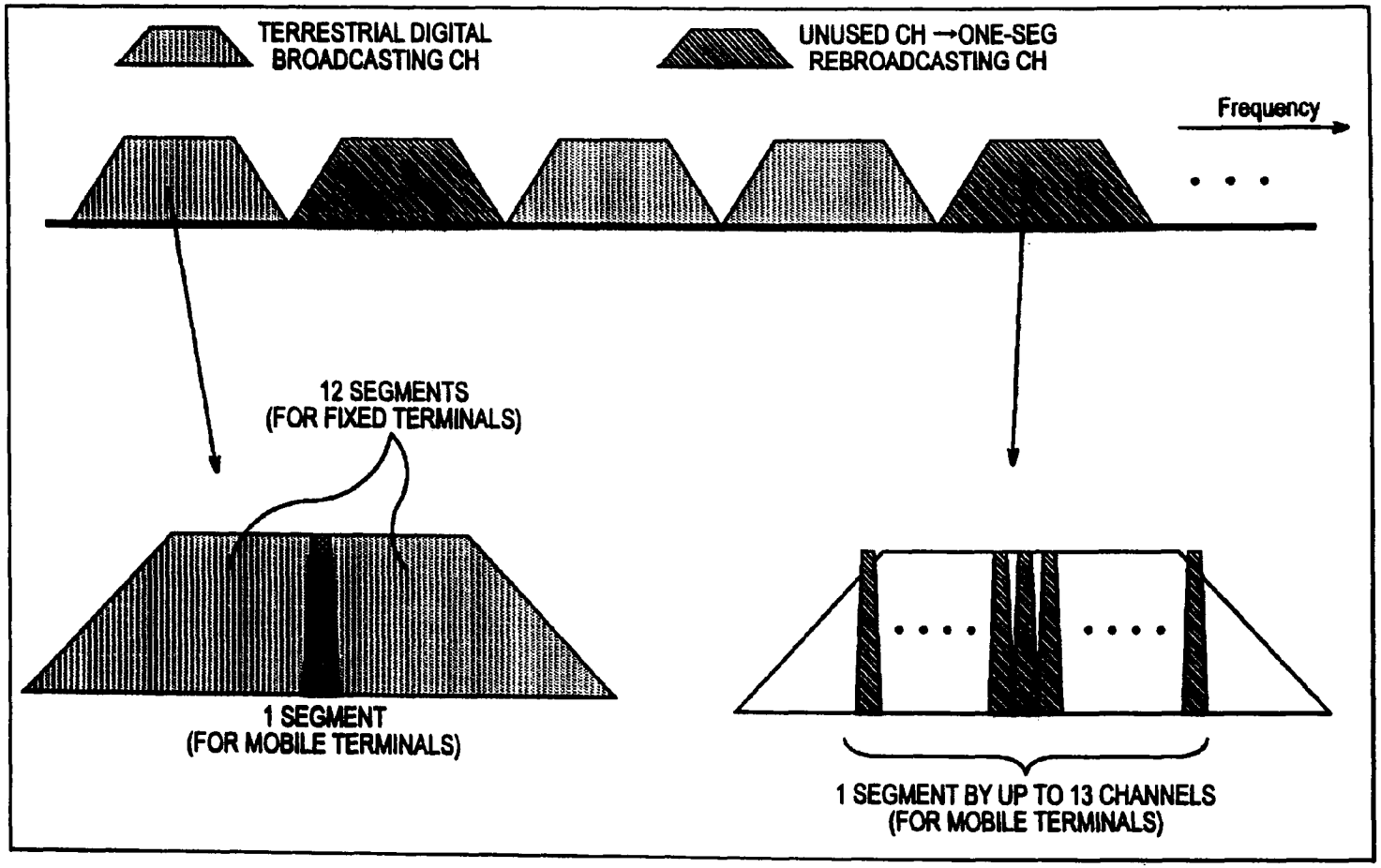
FIG. 5 An illustration of the band allocation of a terrestrial digital broadcasting wave in the transmitting/receiving system in FIG. 4.

FIG. 5 illustrates the band allocation of a terrestrial digital broadcasting wave in the transmitting/receiving system 30 in FIG. 4.

As shown in FIG. 5, in the transmitting/receiving system 30, in a physical channel used for the terrestrial digital broadcasting from the whole bands of the terrestrial digital broadcasting wave, a One-Seg broadcasting is performed in the band of one segment at the center, and a broadcasting for fixed terminals is performed in the band of remaining 12 segments.

On the other hand, in an unused channel, a One-Seg rebroadcasting is transmitted in multi-segment broadcasting. Note that up to 13 logical channels of One-Seg rebroadcastings can be broadcast in one unused channel.

Figure 6:
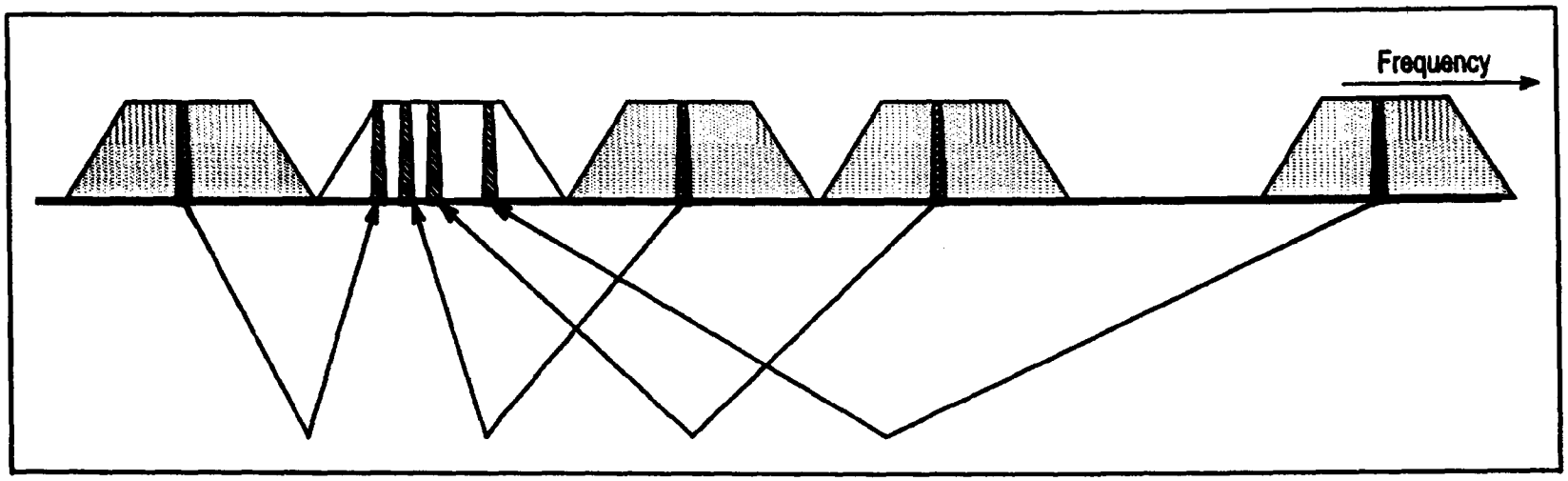
FIG. 6 A configuration example of a multi-segment broadcasting.

FIG. 6 shows a configuration example of a multi-segment broadcasting transmitted in one unused channel.

The multi-segment broadcasting in FIG. 6 consists of One-Seg broadcastings transmitted in the center segments of four physical channels.

[Method for Obtaining Tuning Information]

Figure 7:
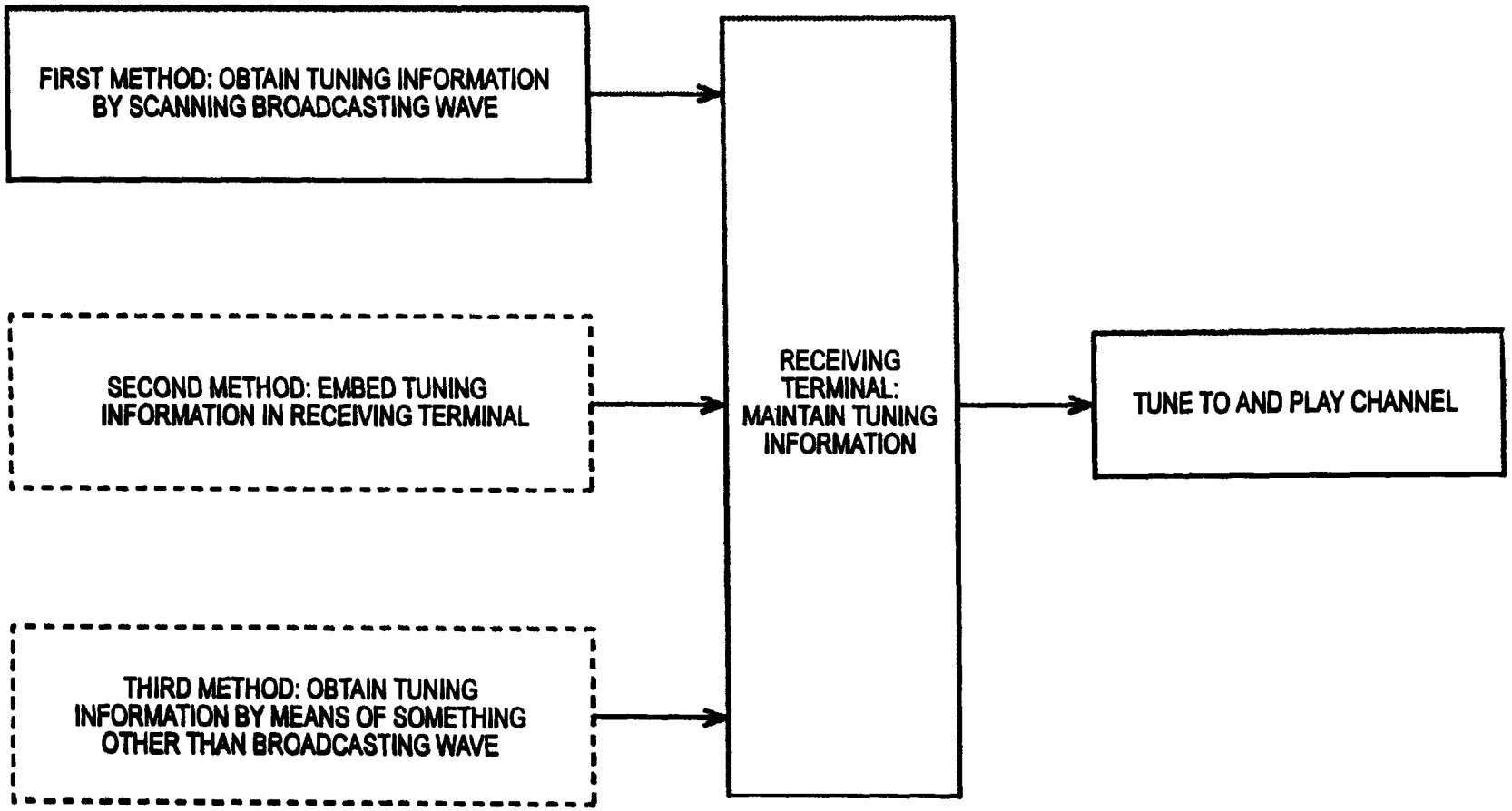
FIG. 7 An illustration of methods for obtaining tuning information of One-Seg rebroadcasting.

FIG. 7 illustrates a method for obtaining tuning information of a One-Seg rebroadcasting in the transmitting/receiving system 30.

As shown in FIG. 7, in order to obtain tuning information of a One-Seg rebroadcasting, three methods may generally be used. A first method is to obtain tuning information by scanning broadcasting wave. For the first method, the receiving terminal can obtain tuning information of a receivable One-Seg rebroadcasting only by scanning the terrestrial digital broadcasting wave. So, a user having the receiving terminal can automatically obtain tuning information of the receivable One-Seg rebroadcasting without regard to whether a One-Seg rebroadcasting is receivable at the user's current location or not.

A second method is to embed tuning information in the receiving terminal. For the second method, the receiving terminal needs to store tuning information in advance. However, it is difficult to store all of the tuning information of One-Seg rebroadcastings varying regionally. So, the second method does not suit to One-Seg rebroadcasting.

A third method is to obtain tuning information by means of something other than broadcasting wave (e.g., communication over Internet or the like). For the third method, a user having the receiving terminal needs to know whether a One-Seg rebroadcasting is receivable at the user's current location or not and indicate to obtain tuning information of that One-Seg rebroadcasting if any. However, it is difficult to know all of One-Seg rebroadcastings varying regionally along with their regions. So, the third method does not suit to One-Seg rebroadcasting.

Based on the above, the transmitting/receiving system 30 employs the first method to obtain tuning information of a One-Seg rebroadcasting. Specifically, the terrestrial broadcasting station 31 and the One-Seg retransmitting station 32 transmit tuning information on the terrestrial digital broadcasting wave, and the receiving terminal 33 obtains the tuning information by scanning and maintains it. Then, based on the maintained tuning information, the receiving terminal 33 tunes to and plays a predetermined logical channel of One-Seg rebroadcasting.

[Detailed Configuration Example of One-Seg Retransmitting Station]

Figure 8:
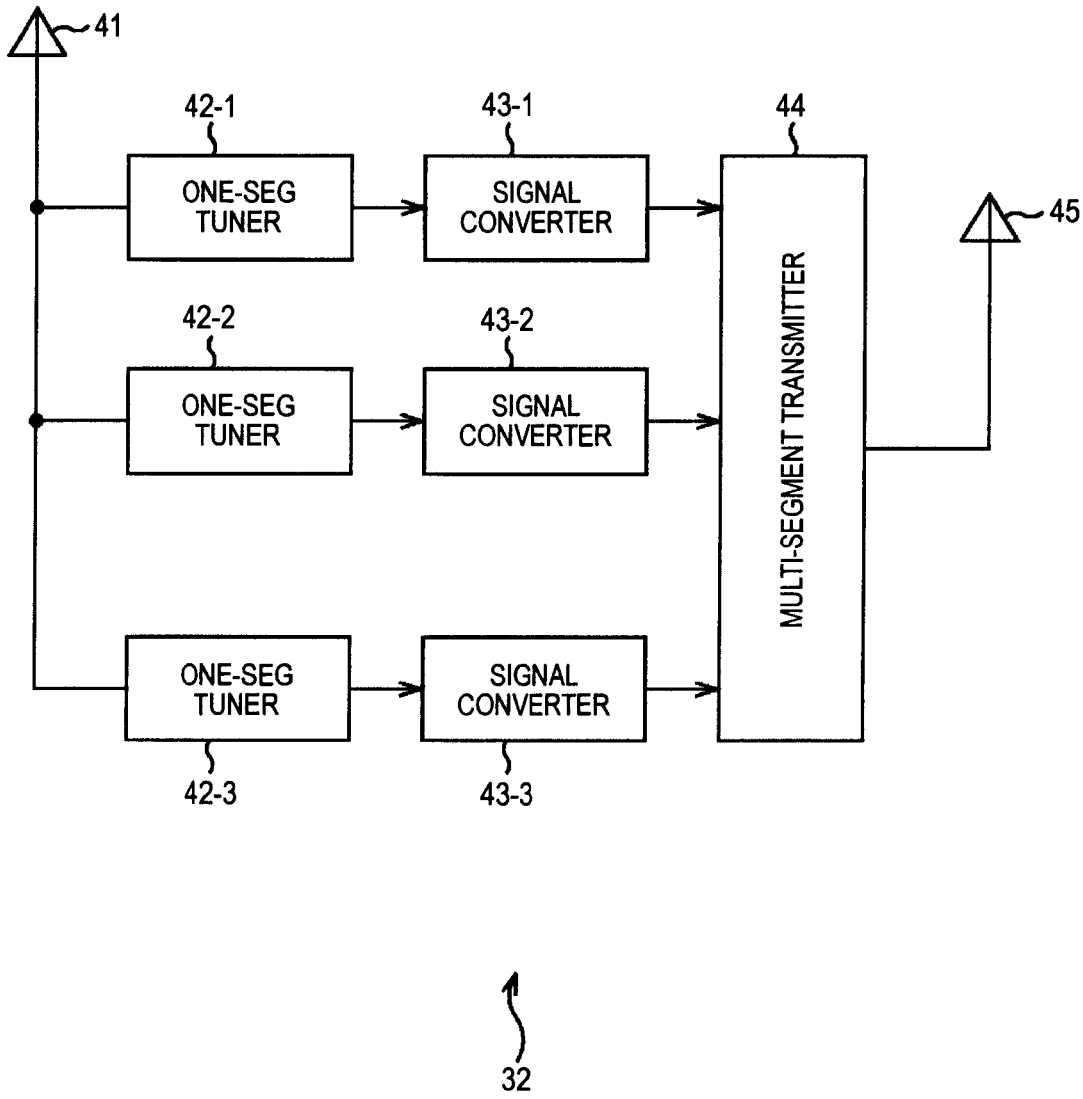
FIG. 8 A block diagram showing a detailed configuration example of a One-Seg retransmitting station.

FIG. 8 is a block diagram showing a detailed configuration example of the One-Seg retransmitting station 32.

The One-Seg retransmitting station 32 in FIG. 8 includes a receiving antenna 41, One-Seg tuners 42-1 to 42-3, signal converters 43-1 to 43-3, a multi-segment transmitter 44 and a transmitting antenna 45.

The One-Seg tuner 42-1 tunes to a predetermined center segment of a terrestrial digital broadcasting transmitted from the terrestrial broadcasting station 31 and received via the receiving antenna 41 and provides the TS of a One-Seg broadcasting transmitted in the center segment to the signal converter 43-1. The TS of the One-Seg broadcasting contains video data or audio data, an NIT, an SDT and the like of the One-Seg broadcasting.

As with the One-Seg tuner 42-1, the One-Seg tuners 42-2 and 42-3 tune to a predetermined center segment of the terrestrial digital broadcasting and provide the TS of a One-Seg broadcasting transmitted in the center segment to the signal converters 43-2 and 43-3.

When the TS of the One-Seg broadcasting provided from the One-Seg tuner 42-1 is a TS to be transmitted in the center segment of a multi-segment broadcasting, the signal converter 43-1 changes the NIT contained in the TS of the One-Seg broadcasting to generate an NIT of the center segment of the multi-segment broadcasting. The signal converter 43-1 provides the TS of the One-Seg broadcasting updated with the generated NIT to the multi-segment transmitter 44 as the TS of a One-Seg rebroadcasting to be transmitted in the center segment.

On the other hand, when the TS of the One-Seg broadcasting from the One-Seg tuner 42-1 is not a TS to be transmitted in the center segment of the multi-segment broadcasting, the signal converter 43-1 maintains the TS of the One-Seg broadcasting from the One-Seg tuner 42-1 as it is. Then the signal converter 43-1 provides the TS to the multi-segment transmitter 44 as the TS of a One-Seg rebroadcasting to be transmitted in a segment other than the center segment of the multi-segment broadcasting (hereinafter referred to as a non-center segment).

As with the signal converter 43-1, the signal converters 43-2 and 43-3 change the NIT contained in the TS of a One-Seg broadcasting from the One-Seg tuner 42-1 to generate an NIT of the center segment of the multi-segment broadcasting. Then, the signal converters 43-2 and 43-3 provide the TS of the One-Seg broadcasting updated with the generated NIT to the multi-segment transmitter 44 as the TS of a One-Seg rebroadcasting to be transmitted in the center segment. Also, as with the signal converter 43-1, the signal converters 43-2 and 43-3 provide the TS of the One-Seg broadcasting from the One-Seg tuner 42-1 as it is to the multi-segment transmitter 44 as the TS of a One-Seg rebroadcasting to be transmitted in a non-center segment.

Note that, hereinafter, the One-Seg tuners 42-1 to 42-3 are collectively referred to as a One-Seg tuner 42 when they need not be individually distinguished. Similarly, the signal converters 43-1 to 43-3 are referred to as a signal converter 43. Also, three One-Seg tuners 42 and three signal converters 43 are provided in FIG. 8, but their number is not limited to three.

The multi-segment transmitter 44 transmits the TS of the One-Seg rebroadcasting provided from the signal converter 43 to be transmitted in the center segment, via the transmitting antenna 45 in the center segment. Also, the multi-segment transmitter 44 transmits the TS of the One-Seg rebroadcasting provided from the signal converter 43 to be transmitted in a non-center segment, via the transmitting antenna 45 in a non-center segment.

As above, since the One-Seg retransmitting station 32 transmits the NIT of the One-Seg broadcasting as it is, as the NIT of a non-center segment, the signal converter 43 only have to be able to change the NIT of the center segment. Thus, the cost of the One-Seg retransmitting station 32 can be reduced in comparison with the case that the NITs of all segments of the multi-segment broadcasting need to be changed.

[Description of NIT]

Figure 9:
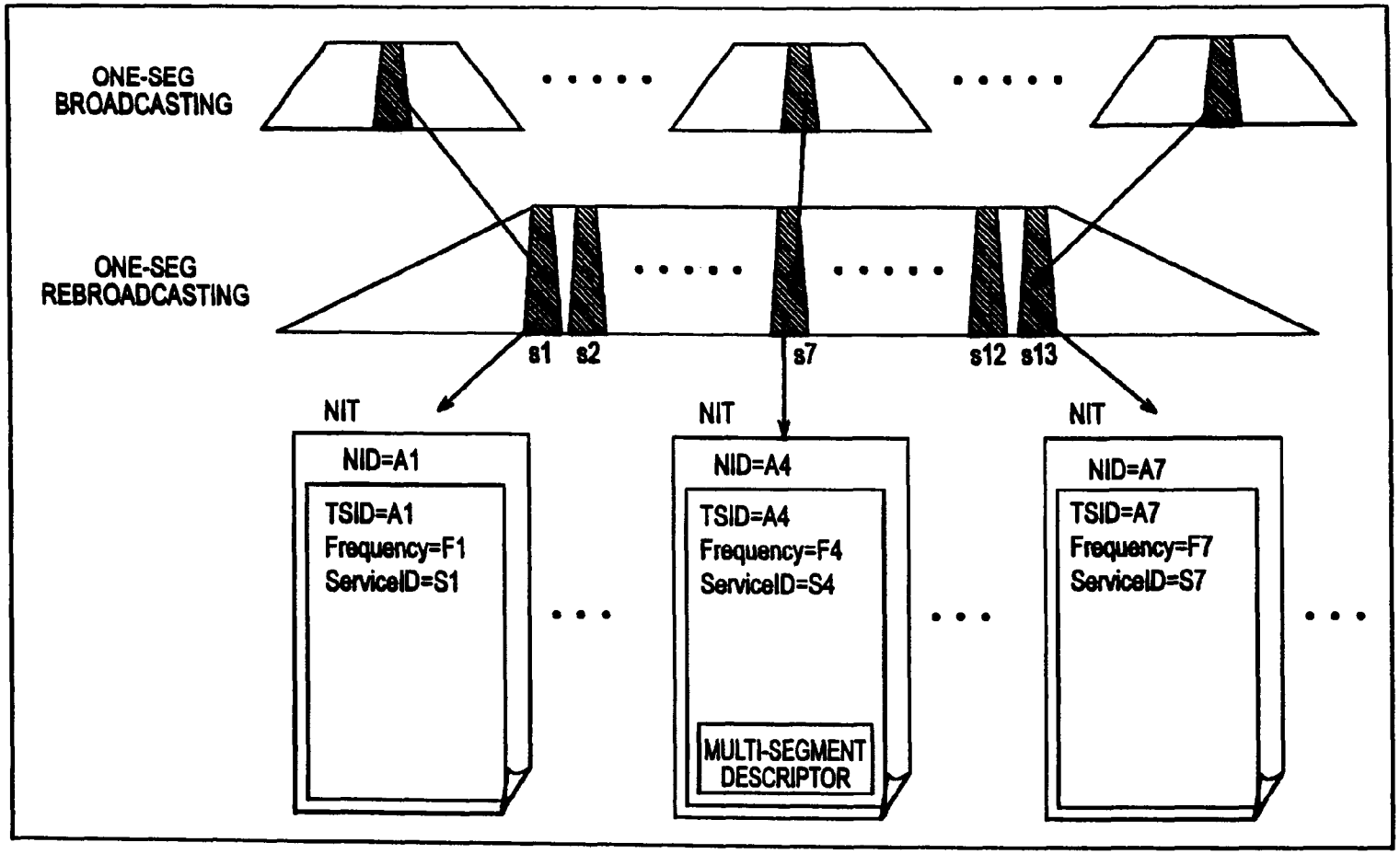
FIG. 9 An illustration of an NIT of a physical channel for One-Seg rebroadcasting.

FIG. 9 illustrates the NITs transmitted in the segments of a physical channel for One-Seg rebroadcasting.

As shown in FIG. 9, in the center segment s7 of the multi-segment broadcasting, the NIT of the One-Seg broadcasting received by the One-Seg retransmitting station 32 with a multi-segment information descriptor (described later in detail) and the like appended there to is transmitted as the NIT of the One-Seg rebroadcasting. On the other hand, in non-center segments s1, s2, . . . , s12, s13, the NITs of the One-Seg broadcastings received by the One-Seg retransmitting station 32 as they are transmitted as the NITs of the One-Seg rebroadcastings.

The NIT of the One-Seg broadcasting received by the One-Seg retransmitting station 32 includes a network ID, information on the TS of the One-Seg broadcasting (hereinafter referred to as TS information) and the like. The TS information includes the TSID of the TS, a frequency, a service ID and the like of the One-Seg broadcasting.

As above, the NIT of the center segment of the One-Seg rebroadcasting in the multi-segment broadcasting is the NIT of the One-Seg broadcasting with the multi-segment information descriptor and the like appended thereto. Thus, the multi-segment information descriptor may be information indicating that the center segment transmitting the multi-segment information descriptor is a segment of the multi-segment broadcasting.

Figure 10:
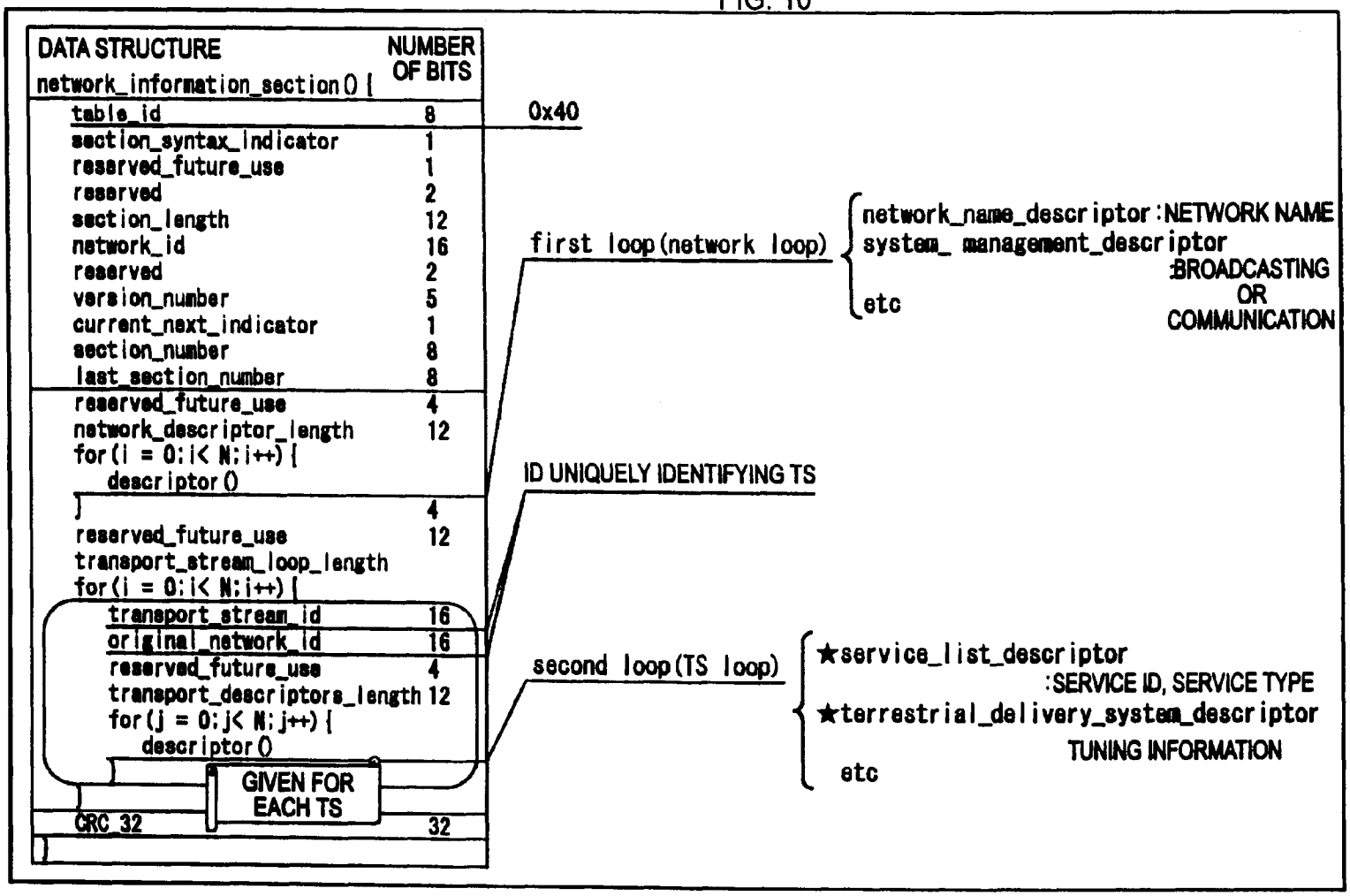
FIG. 10 A data structure of the NIT.

FIG. 10 shows a data structure of the NIT.

As shown in FIG. 10, in the NIT, an 8-bit table ID (table_id), a 1-bit section syntax indicator (section_syntax_indicator) and a 1-bit area for future use (reserved_future_use) are arranged from the top in this order. For example, 0x40 is given for the table ID.

Furthermore, following the area for future use, a 2-bit reserved area (reserved), a 12-bit section length (section_length), a 16-bit network ID (network_ID), a 2-bit reserved area (reserved) and a 5-bit version number (version_number) are arranged in this order. Then, a 1-bit current next indicator (current_next_indicator), an 8-bit section number (section_number), an 8-bit last section number (last_section_number) and a 4-bit area for future use are arranged in this order.

Then, a 12-bit network descriptor length (network_descriptor_length) and a 4-bit network loop are arranged in this order. In the network loop, descriptors including a network name descriptor (network_name_descriptor), a system management descriptor (system_management_descriptor) and the like are arranged for each network ID given in the previous stage. In the network name descriptor, a network name is given. In the system management descriptor, information on whether the network is a broadcasting network or a communication network is given.

Following the network loop, a 12-bit area for future use, a TS loop length (transport_stream_loop_length), a TS loop and a 32-bit CRC (Cyclic Redundancy Check) 32 value (CRC_32) are arranged in this order. In the TS loop, a service list descriptor (service_list_descriptor), a terrestrial delivery system descriptor (terrestrial_delivery_system_descriptor) and the like are given for each TS. In the service list descriptor, a service ID that is information for identifying broadcasting service and a service type indicating the type of broadcasting service (e.g., television broadcasting, radio broadcasting or the like) are given. In the terrestrial delivery system descriptor, tuning information is given.

Note that, in the NIT of the center segment of the One-Seg rebroadcasting, information on broadcasting for fixed terminals in at least 7 bytes (hereinafter referred to as information on broadcasting for fixed terminals) given in a descriptor in the TS loop of the NIT of the original One-Seg broadcasting is removed. Then, within the range of information amount of the information on broadcasting for fixed terminals, a multi-segment information descriptor (multi_segment_info_descriptor) in which the multi-segment information descriptor is given is placed.

Thus, the multi-segment information descriptor is given within the range of information amount of the information on broadcasting for fixed terminals. Accordingly, the number of packets of the TS of the One-Seg rebroadcasting is equal to the number of packets of the TS of the original One-Seg broadcasting. In other words, the changing of the NIT does not increase the number of packets. Consequently, the changing of the NIT does not require changing of the other information in the TS, which can prevent the function of the One-Seg retransmitting station 32 from becoming complicated.

[Description of Multi-Segment Information Descriptor]

FIG. 11 shows a description example of the multi-segment information descriptor.

As shown in FIG. 11, the multi-segment information descriptor described in the multi-segment information descriptor includes a 8-bit descriptor tag (descriptor_tag), a 8-bit descriptor length (descriptor_length), a 4-bit multi-segment mode (multi_segment_mode), a 4-bit reserved area (reserved) and a 16×N-bit multi-segment bitmap (multi_segment_bitmap).

The multi-segment mode is a mode indicating the interval between the frequencies of the segments of the multi-segment broadcasting (hereinafter referred to as segment interval).

Figure 12:
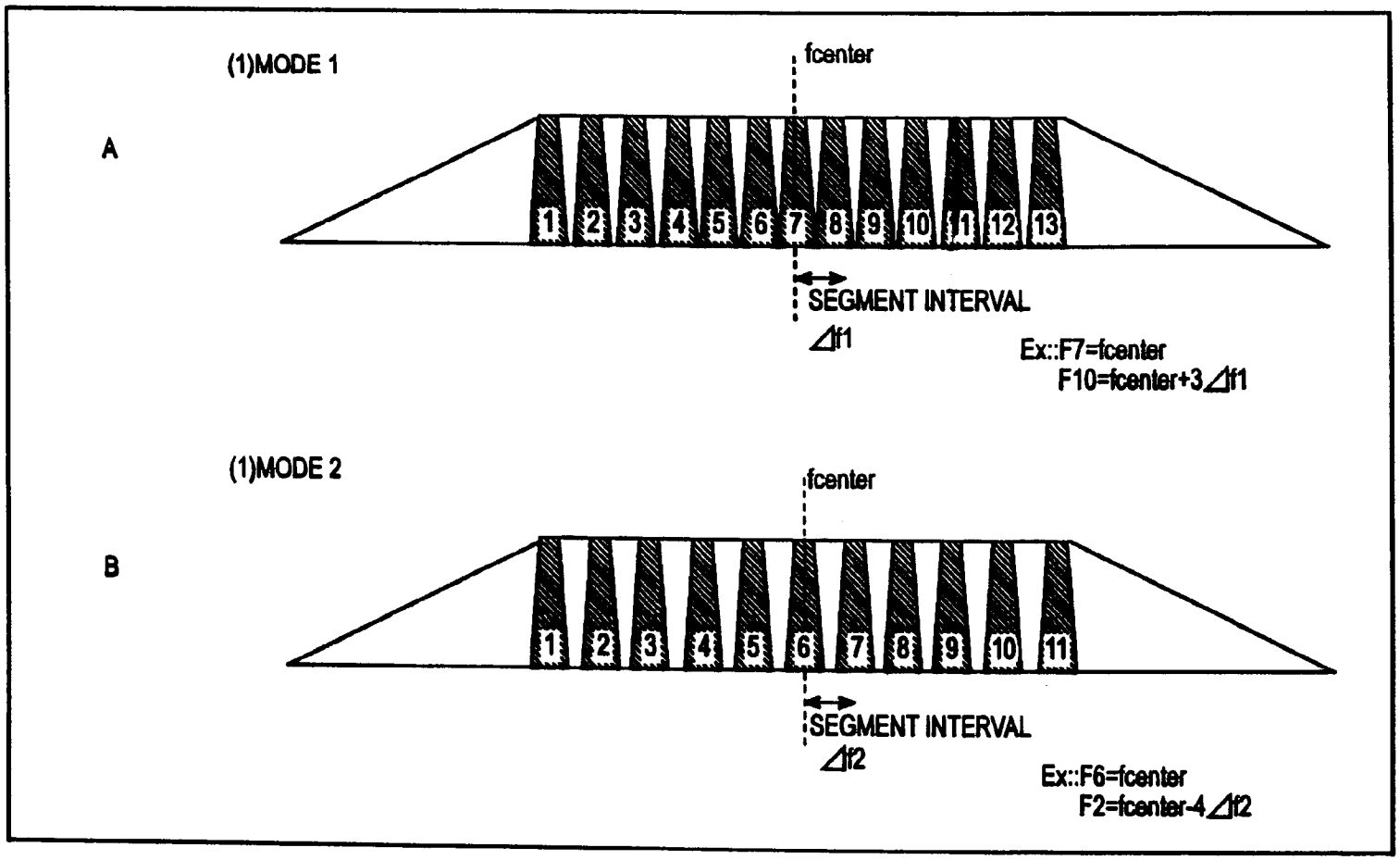
FIG. 12 An example of a multi-segment mode.

FIG. 12 shows an example of the multi-segment mode.

In the multi-segment mode in FIG. 12, a mode 1 shows a segment interval of Δf1 as shown in A of FIG. 12. In this case, the total number of segments of the multi-segment broadcasting is 13. Then, for example, the tenth frequency of the multi-segment broadcasting, F10, is given by F10=fcenter+3Δf1, where fcenter is the frequency of the center segment, or the seventh segment, F7.

Also, in the multi-segment mode in FIG. 12, a mode 2 shows a segment interval of Δf2 as shown in B of FIG. 12. In this case, the total number of segments of the multi-segment broadcasting is 11. Then, for example, the second frequency of the multi-segment broadcasting, F2, is given by F2=fcenter−4Δf2, where fcenter is the frequency of the center segment, or the sixth segment, F6.

Figure 13:
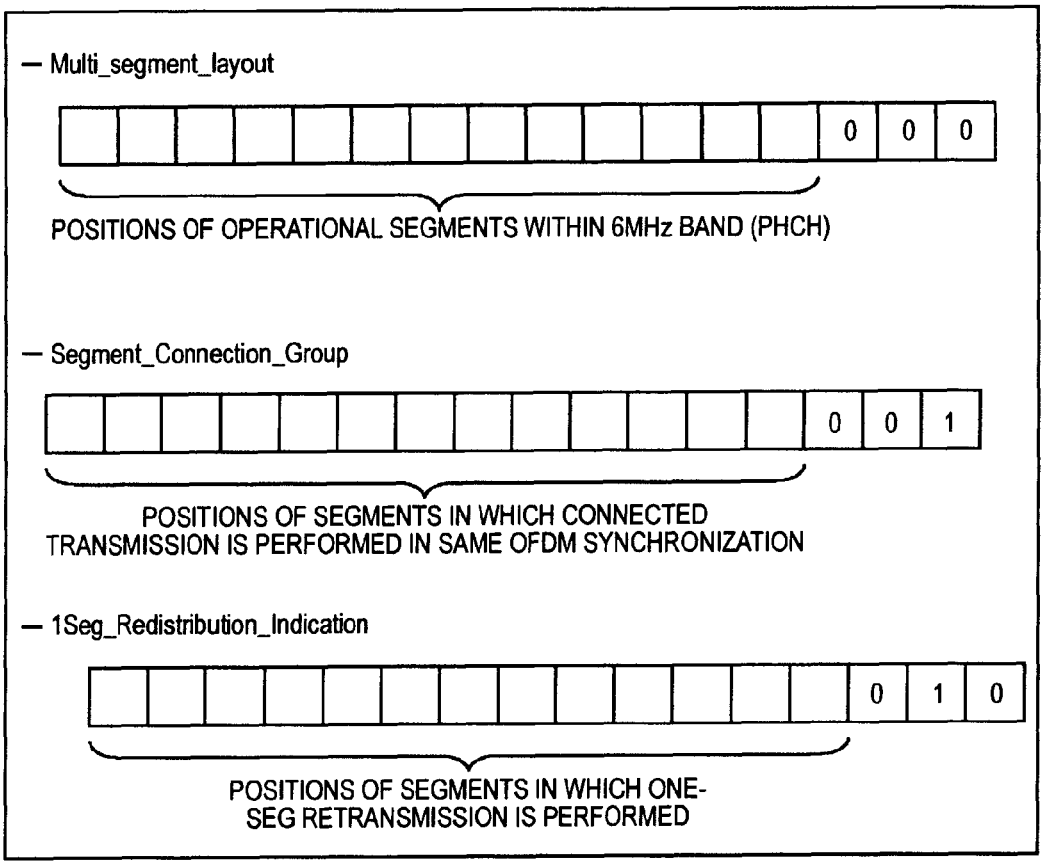
FIG. 13 A configuration example of a multi-segment bitmap.

FIG. 13 shows a configuration example of the multi-segment bitmap.

The multi-segment bitmap in FIG. 13 includes bitmaps, each containing 16 bits, representing multi-segment layout information (Multi_segment_layout), connection information (Segment_Connection_Group) and One-Seg retransmission indication information (1SegRedistribution_Indication). Representing the information using bitmaps in this way allows the amount of information to be minimized.

The multi-segment layout information (layout information) shows the layout of a segment used for the multi-segment broadcasting (hereinafter referred to as broadcasting segment), that is, an operational segment in a physical channel to which the multi-segment broadcasting is allocated.

Specifically, each of the upper 13 bits of the 16-bit bitmap representing the multi-segment layout information corresponds to each segment of the physical channel to which the multi-segment broadcasting is allocated. Then, for example, a bit of "1" indicates that the segment corresponding to the bit is a broadcasting segment, and a bit of "0" indicates that the segment corresponding to the bit is not a broadcasting segment.

The lower 3 bits is used for representing information that the bitmap including the lower 3 bits represents the multi-segment layout information. In the example shown in FIG. 13, "000" indicates that the bitmap represents the multi-segment layout information.

Since, as above, the multi-segment layout information shows the layout of a broadcasting segment, the receiving terminal 33 can recognize, from the multi-segment layout information, where the broadcasting segment is positioned in the physical channel of the multi-segment broadcasting. Also, the receiving terminal 33 previously recognizes the frequency of the center segment of the multi-segment broadcasting, fcenter. So, the receiving terminal 33 can calculate the frequency of a broadcasting segment as shown in FIG. 12.

The connection information shows the layout of a broadcasting segment used for transmitting a One-Seg rebroadcasting by the same One-Seg retransmitting station 32. The connection information is described for each One-Seg retransmitting station 32.

Specifically, each of the upper 13 bits of the 16-bit bitmap representing the connection information corresponds to each segment of the physical channel to which the multi-segment broadcasting is allocated. Then, for example, a bit of "1" indicates that the broadcasting segment corresponding to the bit is transmitted by the same One-Seg retransmitting station 32 that transmits a broadcasting segment corresponding to another bit of "1." On the other hand, a bit of "0" indicates that the broadcasting segment corresponding to the bit is transmitted by a One-Seg retransmitting station 32 different from the One-Seg retransmitting station 32 that transmits the broadcasting segment corresponding to the bit of "1."

The lower 3 bits is used for representing information that the bitmap including the lower 3 bits represents the connection information. In the example shown in FIG. 13, "001" indicates that the bitmap represents the connection information.

The connection information represented in this way allows reducing of the time taken for tuning in the receiving terminal 33. Specifically, the TS transmitted by the same One-Seg retransmitting station 32 are OFDM (Orthogonal Frequency Division Multiplexing) synchronized. So, the receiving terminal 33 can omit OFDM synchronization in tuning to reduce the time taken for tuning, by continuously tuning to broadcasting segments used for transmission by the same One-Seg retransmitting station 32.

Figure 14:
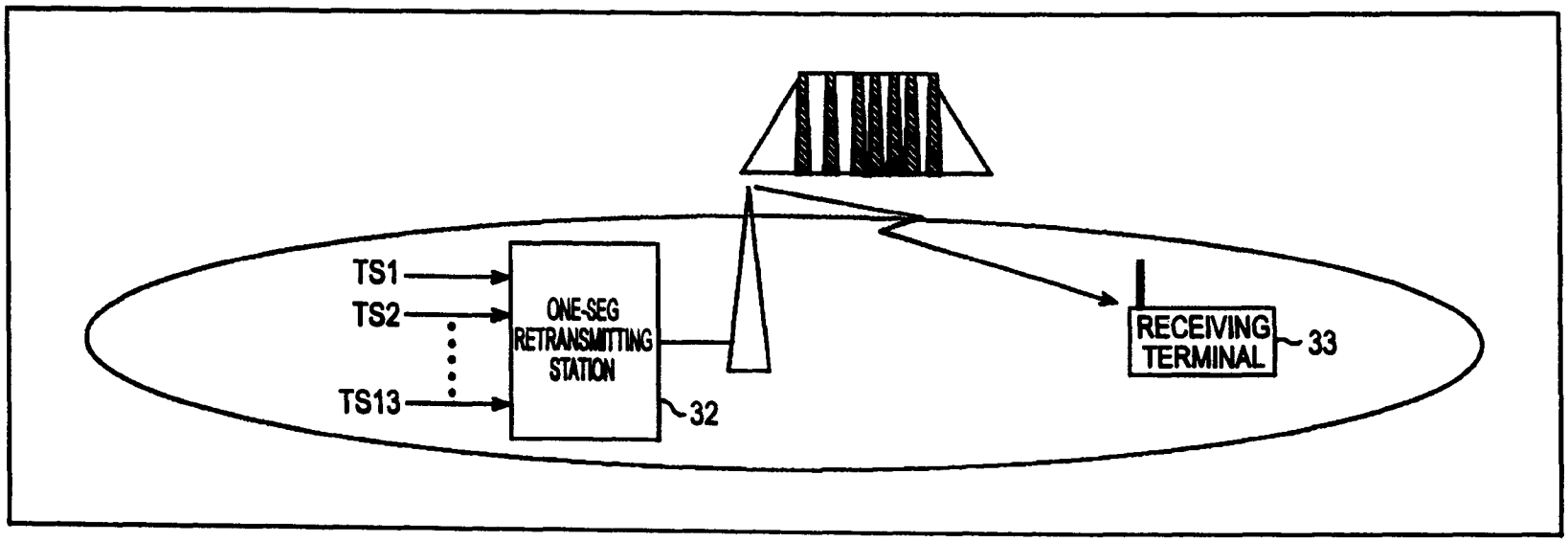
FIG. 14 A transmission scheme of One-Seg rebroadcasting.

In the transmitting/receiving system 30 in FIG. 4, since, as shown in FIG. 14, one One-Seg retransmitting station 32 transmits the TSs of the One-Seg rebroadcastings for all broadcasting segments, the time taken for tuning is short without regard to the order of tuning to the broadcasting segments.

Figure 15:
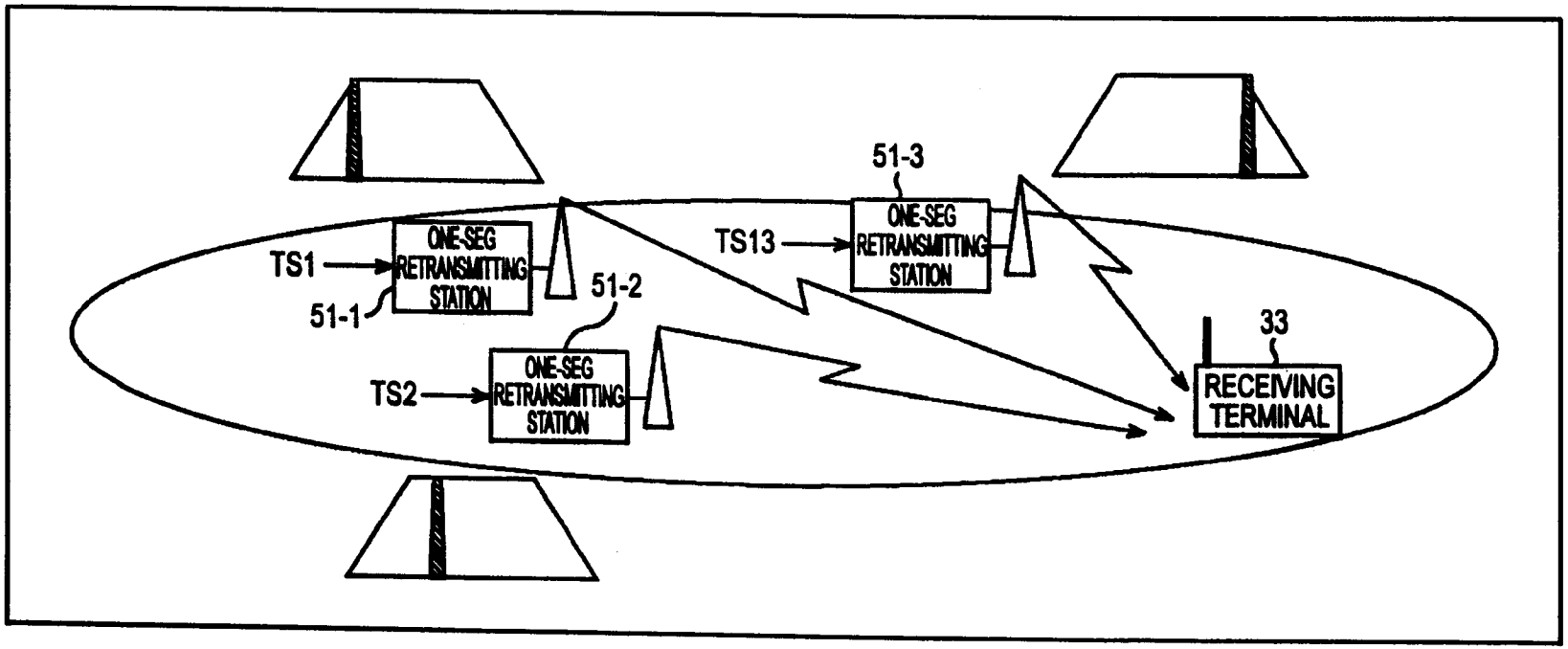
FIG. 15 Another transmission scheme of One-Seg rebroadcasting.

However, another transmission scheme of One-Seg rebroadcasting of the transmitting/receiving system 30 may be a distributed scheme in which the TS of a One-Seg rebroadcasting is transmitted by a different One-Seg retransmitting station for each broadcasting segment, as shown in FIG. 15. In the example in FIG. 15, each of three One-Seg retransmitting stations 51-1 to 51-3 transmits the TS of a One-Seg rebroadcasting for one broadcasting segment.

Figure 16:
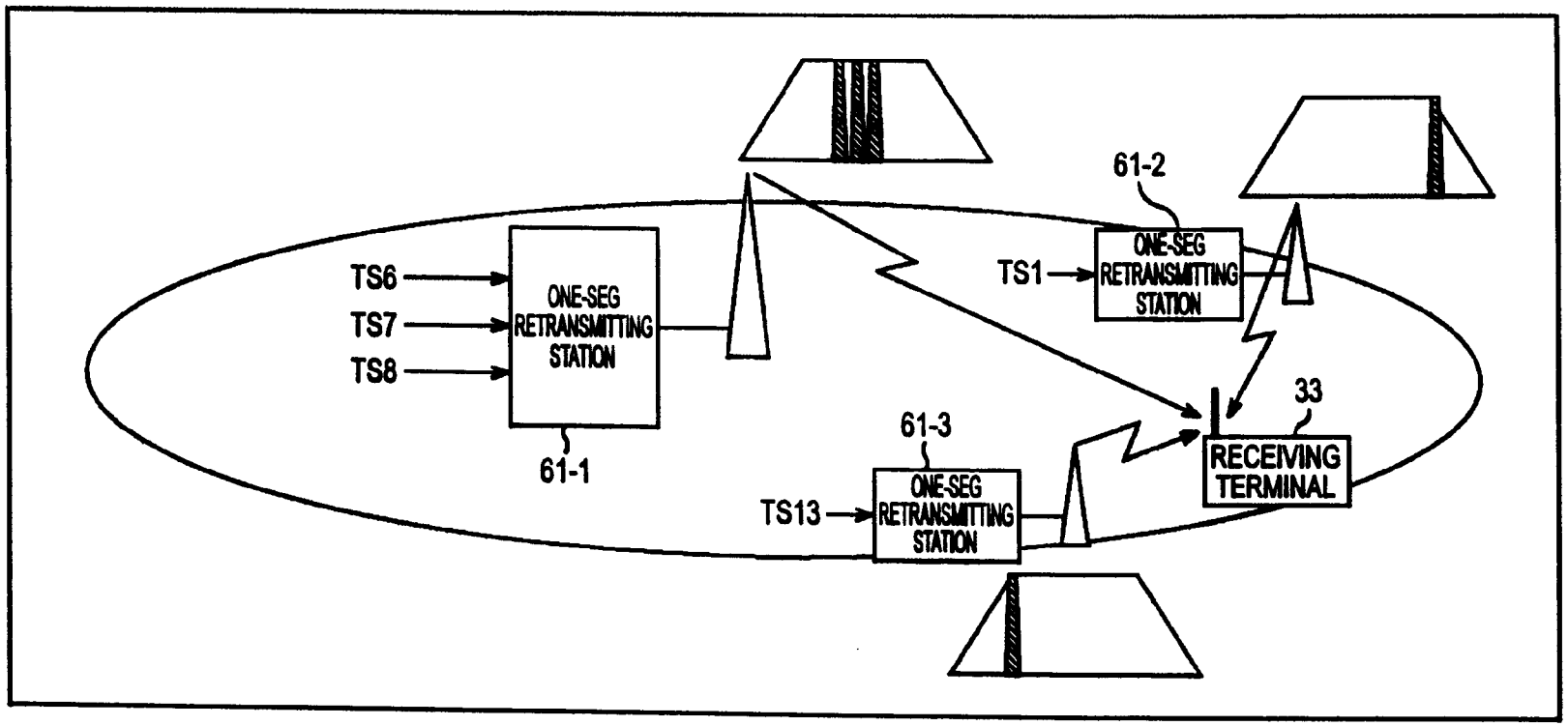
FIG. 16 Yet another transmission scheme of One-Seg rebroadcasting.

Furthermore, another transmission scheme of One-Seg rebroadcasting of the transmitting/receiving system 30 may be a transmission scheme that is a hybrid of the centralized scheme in which one One-Seg retransmitting station 32 transmits the TSs of the One-Seg rebroadcastings for all broadcasting segments and the distributed scheme, as shown in FIG. 16, hereinafter referred to as hybrid scheme. In the example in FIG. 16, one One-Seg retransmitting station 61-1 transmits the TS of One-Seg rebroadcastings for three broadcasting segments, and each of two One-Seg retransmitting stations 61-2 and 61-3 transmits the TS of a One-Seg rebroadcasting for one broadcasting segment.

Thus, when the transmission scheme is the distributed or hybrid scheme, the time taken for tuning differs depending on the order of tuning to broadcasting segments. Specifically, when broadcasting segments used for transmission by the same One-Seg retransmitting station are continuously tuned to, OFDM synchronization is omitted to reduce the time taken for tuning. However, when broadcasting segments used for transmission by different One-Seg retransmitting stations are continuously tuned to, OFDM synchronization is performed to increase the time taken for tuning.

Figure 17:
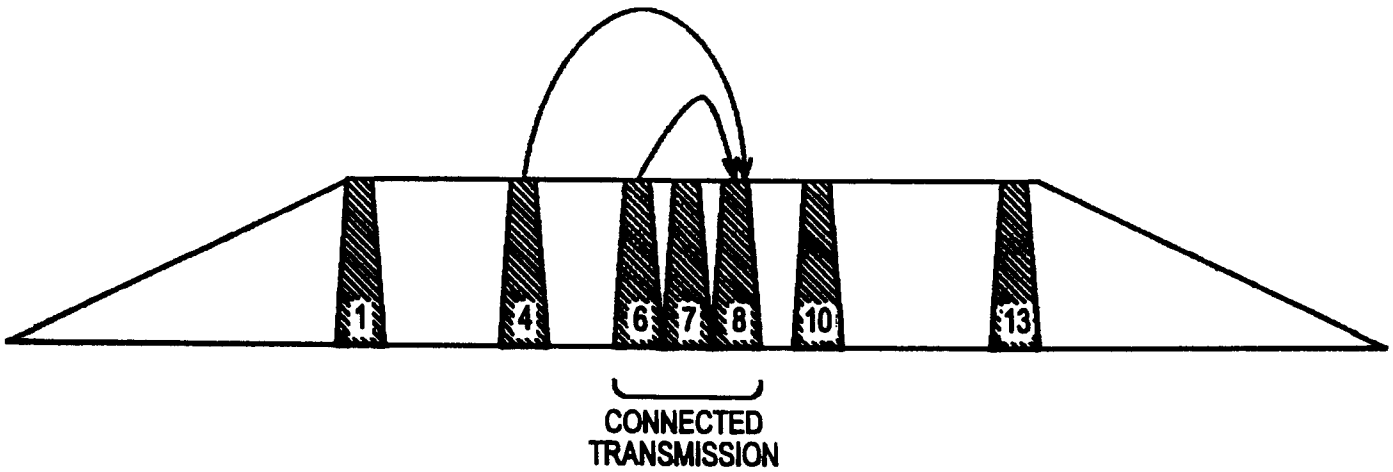
FIG. 17 An illustration of tuning order control based on connection information.

Thus, in the transmitting/receiving system 30, the One-Seg retransmitting station 32 transmits connection information, and the receiving terminal 33 controls the order of tuning based on the connection information to reduce the time taken for tuning. For example, as shown in FIG. 17, when the connection information indicates that the sixth to eighth segments are the broadcasting segments of the same One-Seg retransmitting station, the receiving terminal 33 tunes to the eighth segment after tuning to the sixth segment. This allows the eighth segment to be tuned to in a shorter time than the case of tuning to the eighth segment after tuning to a broadcasting segment of a different One-Seg retransmitting station (e.g., the fourth segment).

Returning to FIG. 13, the One-Seg retransmission indication information (retransmission information) shows the layout of a segment used for a One-Seg rebroadcasting among the broadcasting segments.

Specifically, each of the upper 13 bits of the 16-bit bitmap representing the One-Seg retransmission indication information corresponds to each segment of the physical channel to which the multi-segment broadcasting is allocated. Then, for example, a bit of "1" indicates that the broadcasting segment corresponding to the bit is a broadcasting segment of a One-Seg rebroadcasting. On the other hand, a bit of "0" indicates that the broadcasting segment corresponding to the bit is a broadcasting segment of a broadcasting that is not a One-Seg rebroadcasting.

Note that, since, in the transmitting/receiving system 30, all of the broadcasting transmitted in the multi-segment broadcasting are a One-Seg rebroadcasting, the upper 13 bits of the bitmap of the One-Seg retransmission indication information are equal to the upper 13 bits of the bitmap of the multi-segment layout information.

The lower 3 bits of the One-Seg retransmission indication information is used for representing information that the bitmap represents the One-Seg retransmission indication information. In the example shown in FIG. 13, "010" indicates that the bitmap represents the One-Seg retransmission indication information.

Note that, when the information amount of the information on broadcasting for fixed terminals to be removed is small, the multi-segment bitmap may not include the bitmaps of the connection information and the multi-segment layout information.

On the other hand, when the information amount of the information on broadcasting for fixed terminals to be removed is large and a descriptor other than the multi-segment information descriptor can additionally be placed within the information amount of the information on broadcasting for fixed terminals, a One-Seg retransmission information descriptor may be placed.

[Description of One-Seg Retransmission Information Descriptor]

Figures 18, 19:
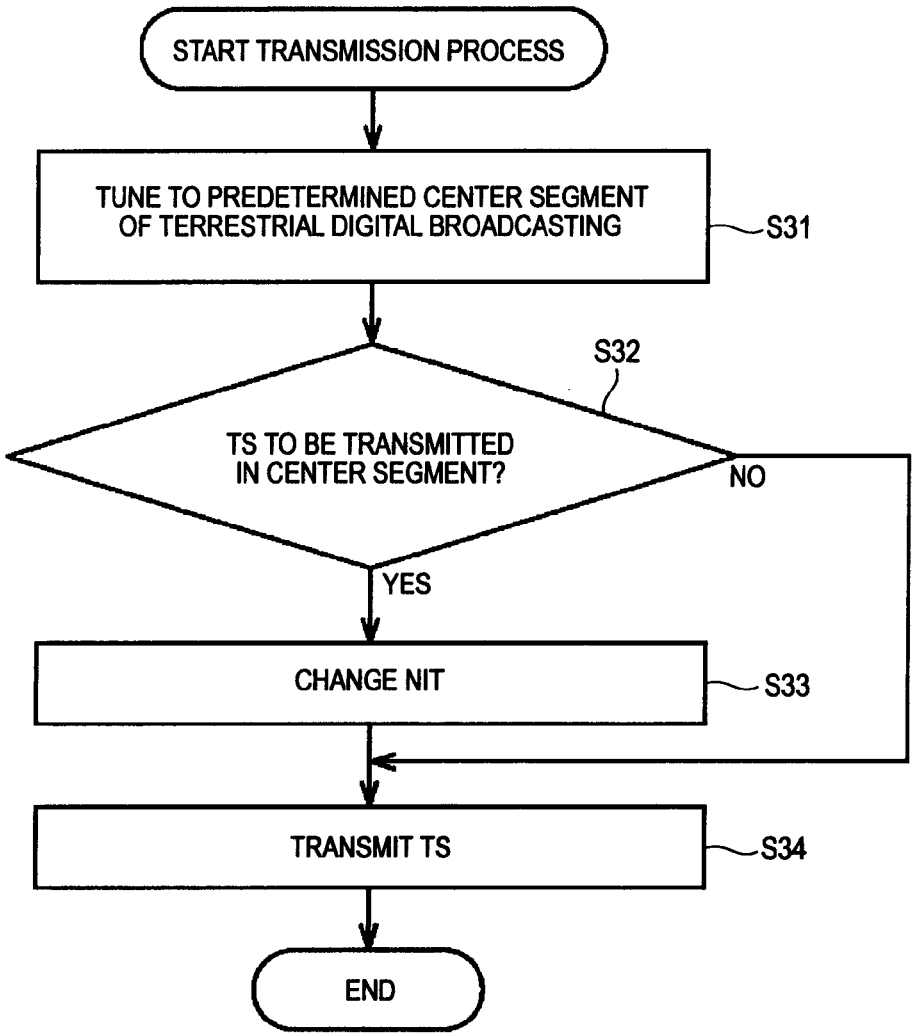
FIG. 18 A detailed configuration example of a One-Seg retransmission information descriptor.
FIG. 19 A flowchart describing the transmission process of the One-Seg retransmitting station.

FIG. 18 shows a detailed configuration example of the One-Seg retransmission information descriptor.

As shown in FIG. 18, the One-Seg retransmission information descriptor (one_Seg_redistribution_info_descriptor) includes a 8-bit descriptor tag (descriptor_tag), a 8-bit descriptor length (descriptor_length), a 8-bit TS number (no_of_ts) and a 16×N-bit terrestrial digital broadcasting network ID (terrestrial_network_id).

The TS number is the TSID of the multi-segment broadcasting of the physical channel including the center segment in which the One-Seg retransmission information descriptor is placed. Also, for the network ID, information identifying the original One-Seg broadcasting of the One-Seg rebroadcasting of the broadcasting segment is given in ascending order of frequencies of the broadcasting segments.

[Description of Process of One-Seg Retransmitting Station]

FIG. 19 is a flowchart describing the transmission process of the One-Seg retransmitting station 32.

In step S31, the One-Seg tuner 42 tunes to a predetermined center segment of the terrestrial digital broadcasting transmitted from the terrestrial broadcasting stations 31 and received via the receiving antenna 41 and provides the TS of a One-Seg broadcasting in the center segment to the signal converter 43.

In step S32, the signal converter 43 determines whether the TS provided from the One-Seg tuner 42 is a TS to be transmitted in the center segment or not. If determined in step S32 that the TS is to be transmitted in the center segment, in step S33, the signal converter 43 changes the NIT of the TS provided from the One-Seg tuner 42.

Specifically, the signal converter 43 removes information on broadcasting for fixed terminals from the NIT and places a multi-segment information descriptor or a multi-segment information descriptor and One-Seg retransmission information descriptor within the information amount of the information on broadcasting for fixed terminals. Then, the signal converter 43 provides the TS containing the changed NIT to the multi-segment transmitter 44, then the process proceeds to step S34.

On the other hand, if determined in step S32 that the TS is not to be transmitted in the center segment, the signal converter 43 provides the TS as it is to the multi-segment transmitter 44, then the process proceeds to step S34.

In step S34, the multi-segment transmitter 44 transmits the TS provided from the signal converter 43, in a predetermined segment via the transmitting antenna 45. Specifically, the multi-segment transmitter 44 transmits the TS with the NIT changed in step S33 in the center segment, and transmits the TS with the NIT unchanged in a non-center segment. Then, the process ends.

[Detailed Configuration Example of Receiving Terminal]

Figure 20:
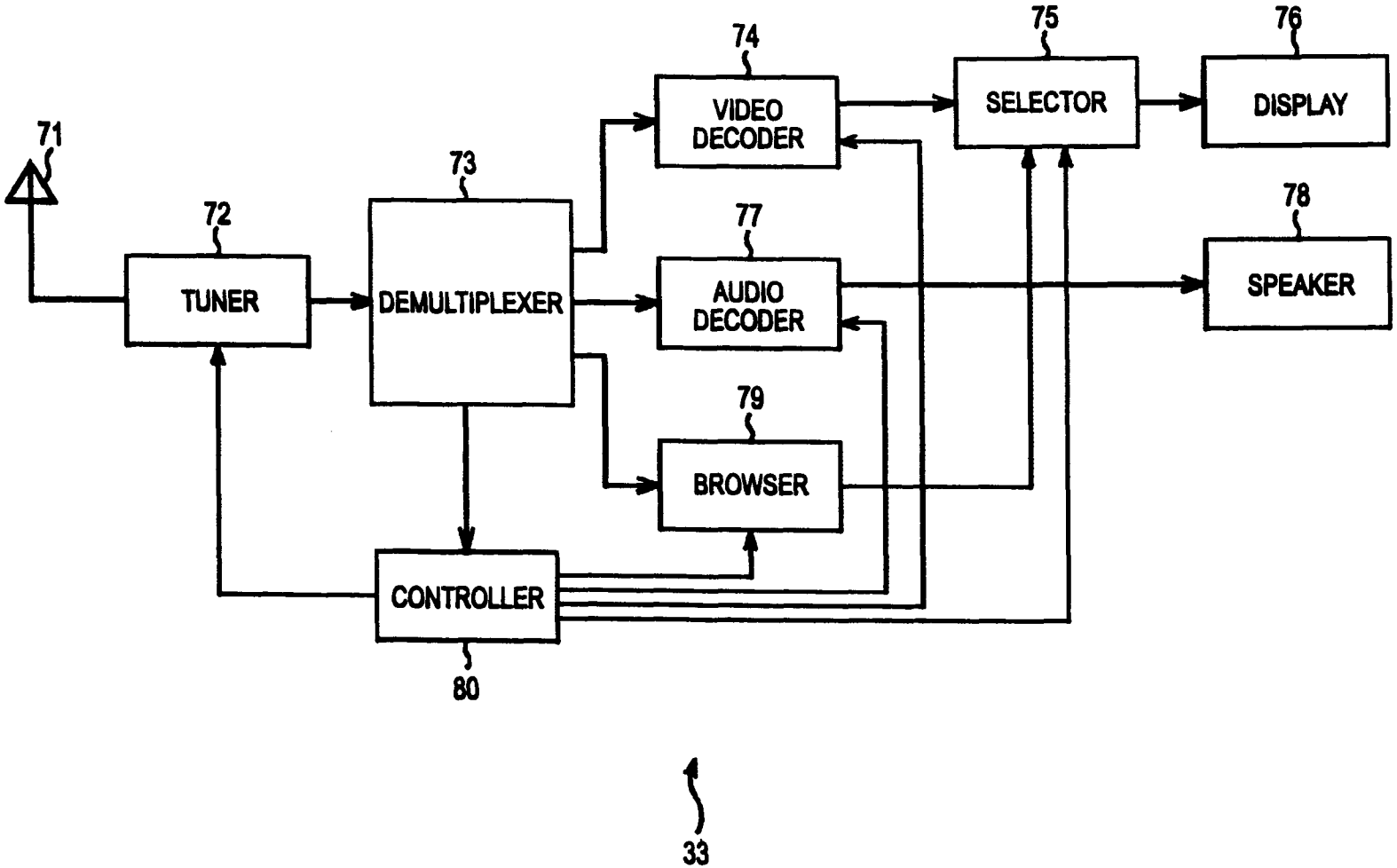
FIG. 20 A block diagram showing a detailed configuration example of the receiving terminal in FIG. 4.

FIG. 20 is a block diagram showing a detailed configuration example of the receiving terminal 33 in FIG. 4.

In FIG. 20, the receiving terminal 33 includes an antenna 71, a tuner 72, a demultiplexer 73, a video decoder 74, a selector 75, a display 76, an audio decoder 77, a speaker 78, a browser 79 and a controller 80.

The tuner 72 performs tuning based on the tuning information provided from the controller 80 and receives a One-Seg rebroadcasting of a predetermined logical channel from the One-Seg retransmitting station 32 via the antenna 71. The tuner 72 provides the received TS to the demultiplexer 73.

The demultiplexer 73 demultiplexes the TS provided from the tuner 72 into various information including video data, audio data, display control information for browser displaying in One-Seg broadcasting and PSI (Program Specific Information). Note that the PSI is collective term of a table including: information for receiving a broadcasting service, such as an NIT, a PMT (Program Map Table), a PAT (Program Association Table) and the like; frequency information; and information identifying a packet corresponding a broadcasting service, and is system control information. The demultiplexer 73 provides the video data to the video decoder 74 and provides the audio data to the audio decoder 77. Also, the demultiplexer 73 provides the display control information to the browser 79 and provides the various information in the PSI to the controller 80.

The video decoder 74 decodes the video data provided from the demultiplexer 73 using a decoding scheme corresponding to an encoding scheme used in the terrestrial broadcasting station 31 and provides the decoded video data to the selector 75, according to the control of the controller 80.

The selector 75 selects the video data provided from the video decoder 74 or the video data provided from the browser 79 and provides the selected video data to the display 76, according to the control of the controller 80. The display 76 displays an image of the One-Seg broadcasting or One-Seg rebroadcasting based on the video data provided from the selector 75.

The audio decoder 77 decodes the audio data provided from the demultiplexer 73 using a decoding scheme corresponding to an encoding scheme used in the terrestrial broadcasting station 31 and provides the decoded audio data to the speaker 78, according to the control of the controller 80. The speaker 78 outputs sound corresponding to the audio data from the audio decoder 77 as sound of the One-Seg broadcasting or One-Seg rebroadcasting.

The browser 79 interprets the display control information provided from the demultiplexer 73 to generate video data and provides the video data to the selector 75.

The controller 80 provides, in turn, tuning information of the center segments of the physical channels of the terrestrial digital broadcasting wave to the tuner 72. Also, the controller 80 calculates the frequencies of the broadcasting segments other than the center segment based on the NIT of the center segment of the One-Seg rebroadcasting and the frequency fcenter. Then, the controller 80 provides the calculated frequencies as tuning information to the tuner 72 in the order based on the connection information.

Furthermore, the controller 80 generates a tuning table based on the NIT and SDT of the One-Seg broadcasting provided from the demultiplexer 73, or the NIT of the center segment of the One-Seg rebroadcastings, the SDTs of the broadcasting segments of the One-Seg rebroadcastings, the frequency fcenter and the calculated frequencies. Then, the controller 80 stores the generated tuning table in a built-in memory (not shown).

Also, in response to an indication from a user, the controller 80 provides service names registered on the tuning table to the browser 79 to cause the service names to be shown on the display 76. The user sees the service names shown on the display 76 to indicate the selection of the service name of a broadcasting service to view. Based on this selection indication, the controller 80 reads from the tuning table tuning information corresponding to the name of the service to view, and provides the tuning information to the tuner 72.

Also, the controller 80 controls the video decoder 74, the selector 75, the audio decoder 77 and the browser 79 based on the various information in the PSI provided from the demultiplexer 73. Specifically, the controller 80, for example, controls the video decoder 74 and the audio decoder 77 so that video data output from the video decoder 74 and audio data output from the audio decoder 77 are synchronized.

[Method for Creating Tuning Table]

Figure 21:
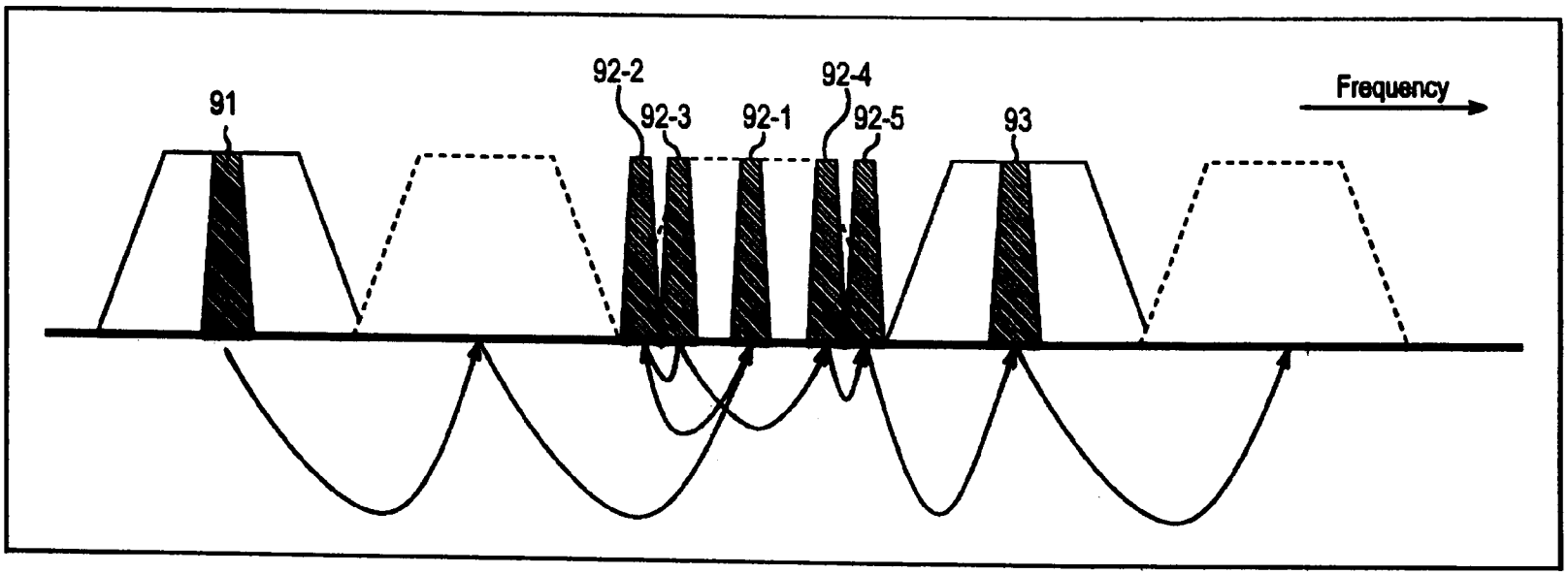
FIG. 21 An illustration of a method for creating a tuning table in the receiving terminal.

FIG. 21 illustrates a method for creating a tuning table in the receiving terminal 33.

As shown in FIG. 21, the receiving terminal 33 scans the center segments of the physical channels of the terrestrial digital broadcasting wave in the order from low to high frequencies. Specifically, the tuner 72 of the receiving terminal 33 tunes to the center segment of each physical channel in the order from low to high frequencies and obtains the TS of the center segment.

Then, first, from the TS of the center segment 91 of a physical channel to which the terrestrial digital broadcasting is allocated, the NIT and SDT of a One-Seg broadcasting to be broadcast in the center segment 91 are obtained. Since the center segment 91 is a segment of the terrestrial digital broadcasting, the NIT of the center segment 91 does not contain a multi-segment information descriptor. Accordingly, the tuning target moves to the center segment of a next physical channel.

Then, in the example in FIG. 21, there is not a TS in the center segment of the next physical channel, so the tuning target further moves to the center segment 92-1 of a next physical channel. Consequently, the NIT and SDT of the broadcasting in the center segment 92-1 are obtained from the TS of the center segment 92-1.

In the example in FIG. 21, since the center segment 92-1 is the center segment of a physical channel to which a One-Seg rebroadcasting is allocated, the NIT of the center segment 92-1 contains a multi-segment information descriptor. Accordingly, the multi-segment layout information and mode information of this multi-segment information descriptor and the frequency fcenter are used to calculate the frequencies of broadcasting segments 92-2 to 92-5 other than the center segment 92-1.

Then, based on the calculated frequencies and the connection information, the broadcasting segments 92-2 to 92-5 other than the center segment 92-1 become the tuning target in turn so that the broadcasting segments for the same One-Seg retransmitting station 32 are continuously arranged. This provides the SDTs of the One-Seg rebroadcastings broadcast in the broadcasting segments 92-2 to 92-5 other than the center segment 92-1.

Then, the tuning target moves to the center segment 93 of a next physical channel. The tuning continues similarly until the tuning has been performed for all of the physical channels of the terrestrial digital broadcasting wave.

Then, the tuning table is created based on the NIT and SDT of the One-Seg broadcasting, or the NIT of the center segment of the One-Seg rebroadcastings, the SDTs of the broadcasting segments of the One-Seg rebroadcastings, the frequency fcenter and the calculated frequencies.

Note that, in the example in FIG. 21, the broadcasting segments 92-2 to 92-5 other than the center segment 92-1 are also tuned to. However, when the NIT of the center segment 92-1 contains a One-Seg retransmission information descriptor, the broadcasting segments 92-2 to 92-5 may not be tuned to. In this case, based on the TSID contained in the One-Seg retransmission information descriptor, the SDT of the original One-Seg broadcasting of the already received One-Seg rebroadcasting is obtained and used in creating the tuning table.

On the other hand, when the NIT of the center segment 92-1 does not contain the bitmap of the multi-segment layout information, the receiving terminal 33 cannot recognize the broadcasting segments 92-2 to 92-5, then tunes to the center segment 92-1 and all of the non-center segments. This allows the receiving terminal 33 to recognize the tuning information of the broadcasting segments other than the center segment.

Figure 22:
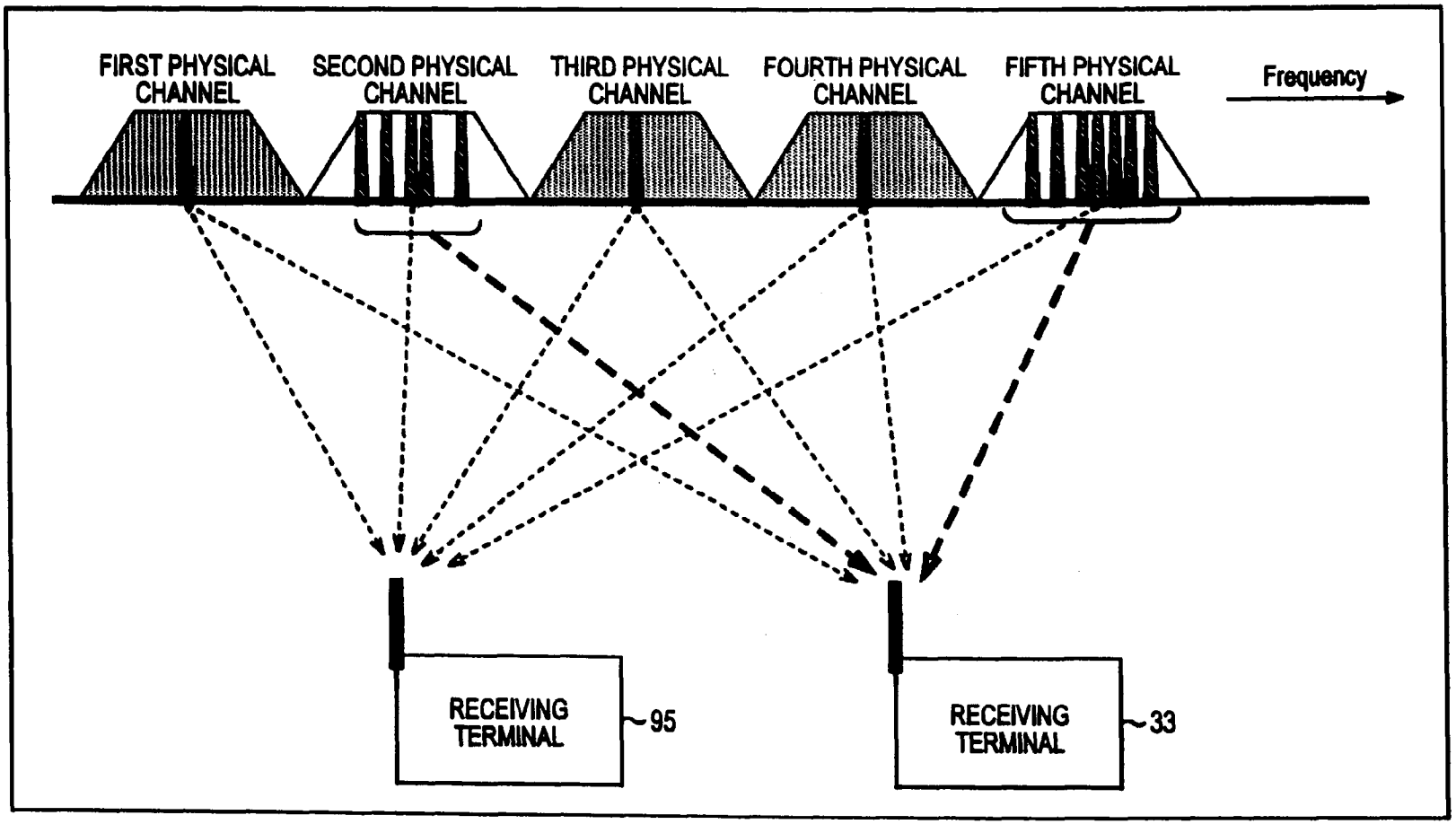
FIG. 22 An illustration of a conventional receiving terminal and the receiving terminal of the invention.

FIG. 22 illustrates a conventional receiving terminal 95 that cannot receive a One-Seg rebroadcasting and the receiving terminal 33 that are receiving the terrestrial digital broadcasting wave in the transmitting/receiving system 30.

The conventional receiving terminal 95 generally scans the center segments of the physical channels in the order from low to high frequencies to create a tuning table, as with the receiving terminal 33. However, since the receiving terminal 95 cannot receive a One-Seg rebroadcasting, the receiving terminal 95 ignores the multi-segment information descriptor of the NIT contained in the TS of the center segment of the physical channel to which the One-Seg rebroadcasting is allocated. So, the receiving terminal 95 does not malfunction, but cannot tune to a broadcasting segment other than the center segment.

Consequently, when the receiving terminal 95 receives the terrestrial digital broadcasting wave in the transmitting/receiving system 30, the tuning table is created from the NITs and SDTs of the One-Seg broadcasting and One-Seg rebroadcasting of the center segments of the terrestrial digital broadcasting.

On the other hand, the receiving terminal 33 can receive a One-Seg rebroadcasting, then can recognize the multi-segment information descriptor of the NIT contained in the TS of the center segment of the physical channel to which the One-Seg rebroadcasting is allocated, and can tune to a broadcasting segment other than the center segment. Consequently, in the receiving terminal 33, the tuning table is created from the NITs and SDTs of all of the One-Seg broadcastings and One-Seg rebroadcastings of the terrestrial digital broadcasting wave.

As above, when the conventional receiving terminal 95 receives the terrestrial digital broadcasting wave in the transmitting/receiving system 30, since the receiving terminal 95 cannot receive a One-Seg rebroadcasting, the receiving terminal 95 cannot register tuning information of the One-Seg rebroadcasting of a non-center segment on the tuning table. However, even the conventional receiving terminal 95 can obtain tuning information of a One-Seg broadcasting transmitted from the terrestrial broadcasting station 31. Thus, the terrestrial digital broadcasting wave of the invention does not interfere with the reception of a One-Seg broadcasting by the conventional receiving terminal 95.

[Configuration Example of Tuning Table]

Figure 23:
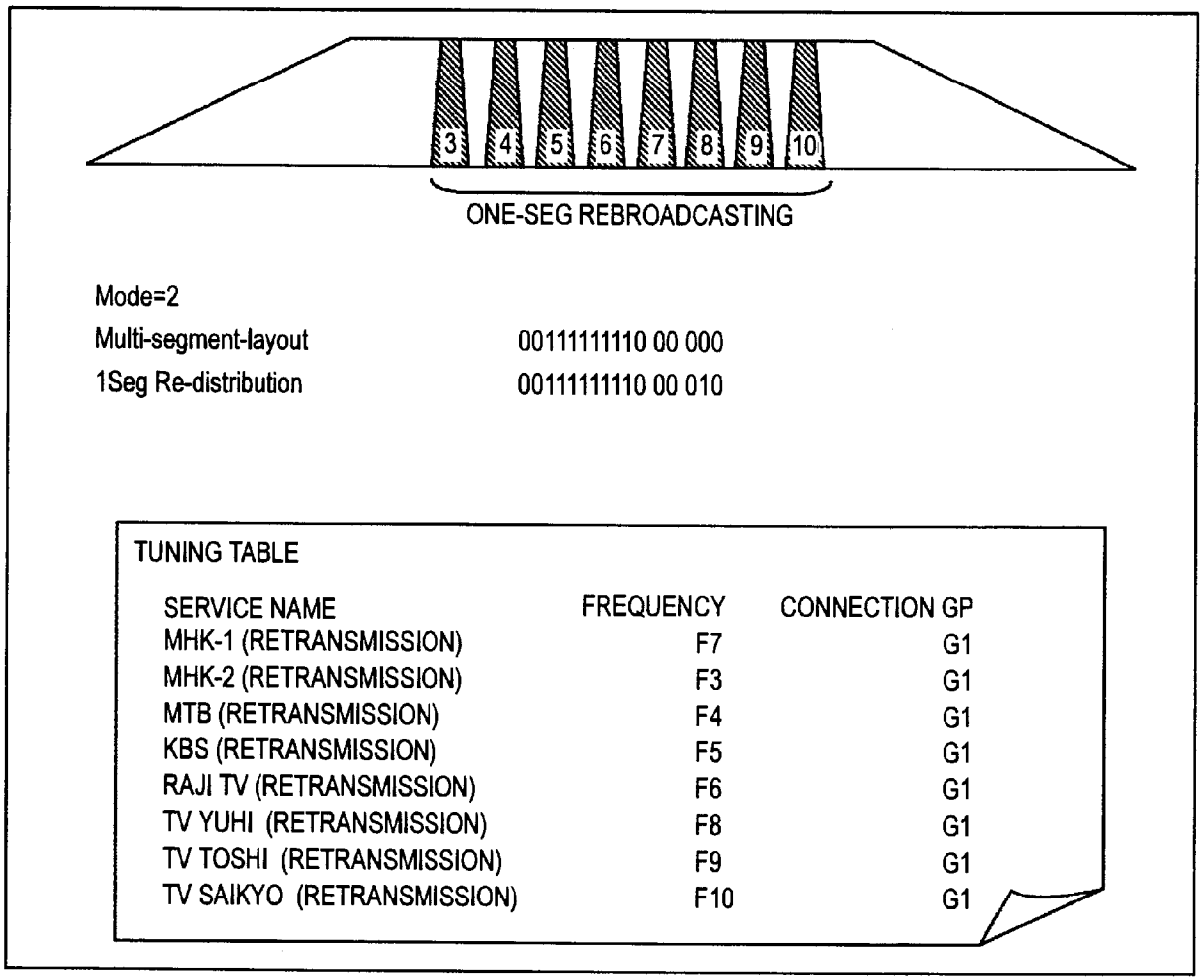
FIG. 23 An example of a tuning table.

FIG. 23 shows an example of the tuning table created by the receiving terminal 33.

In the example in FIG. 23, the third to tenth segments of a physical channel to which One-Seg rebroadcastings are allocated are set to broadcasting segments, and the mode information is set to mode 2. Note that, as shown in FIG. 12, mode 2 indicates that the segment interval is $\Delta f2$ and one physical channel in mode 2 includes 11 segments.

In this case, first, the sixth segment that is the center segment is tuned to and a multi-segment information descriptor is recognized. Then, the frequencies of broadcasting segments other than the center segment are calculated based on the mode information and multi-segment layout information of this multi-segment information descriptor and the frequency fcenter.

Specifically, the frequency Fk is calculated by the expression $Fk=fcenter\pm\Delta fm\times N$, where Fk is the frequency of the k-th segment that is a broadcasting segment, $\Delta fm$ is the segment interval in mode m, and N is the number of segments from the center segment to the k-th segment.

Note that the frequency fcenter of the center segment used in this calculation is not the frequency given in the NIT of the center segment, but is the frequency actually used in tuning to the center segment by the receiving terminal 33. The reason why the frequency given in the NIT of the center segment is not used as the frequency fcenter is because the frequency given in the NIT of the center segment is still the frequency of the original One-Seg broadcasting of the One-Seg rebroadcasting.

When the frequencies of the broadcasting segments are calculated in this way, based on the frequencies of the broadcasting segments, the broadcasting segments other than the center segment are tuned to in the order based on the connection information and the SDTs of the broadcasting segments are obtained. This causes the service names contained in the SDTs of the broadcasting segments and the frequency fcenter or calculated frequencies to be registered on the tuning table.

Also, on the tuning table, the number of the connection group of each broadcasting segment is registered based on the connection information of the multi-segment information descriptor. The number of the connection group corresponds to the source of each broadcasting segment. The same number is given to the broadcasting segments having the same source. In the example in FIG. 23, the TSs of all of the broadcasting segments are transmitted from the same One-Seg retransmitting station 32, then the same connection group number "G1" is registered for all of the broadcasting segments.

[Description of Process of Receiving Terminal]

Figure 24:
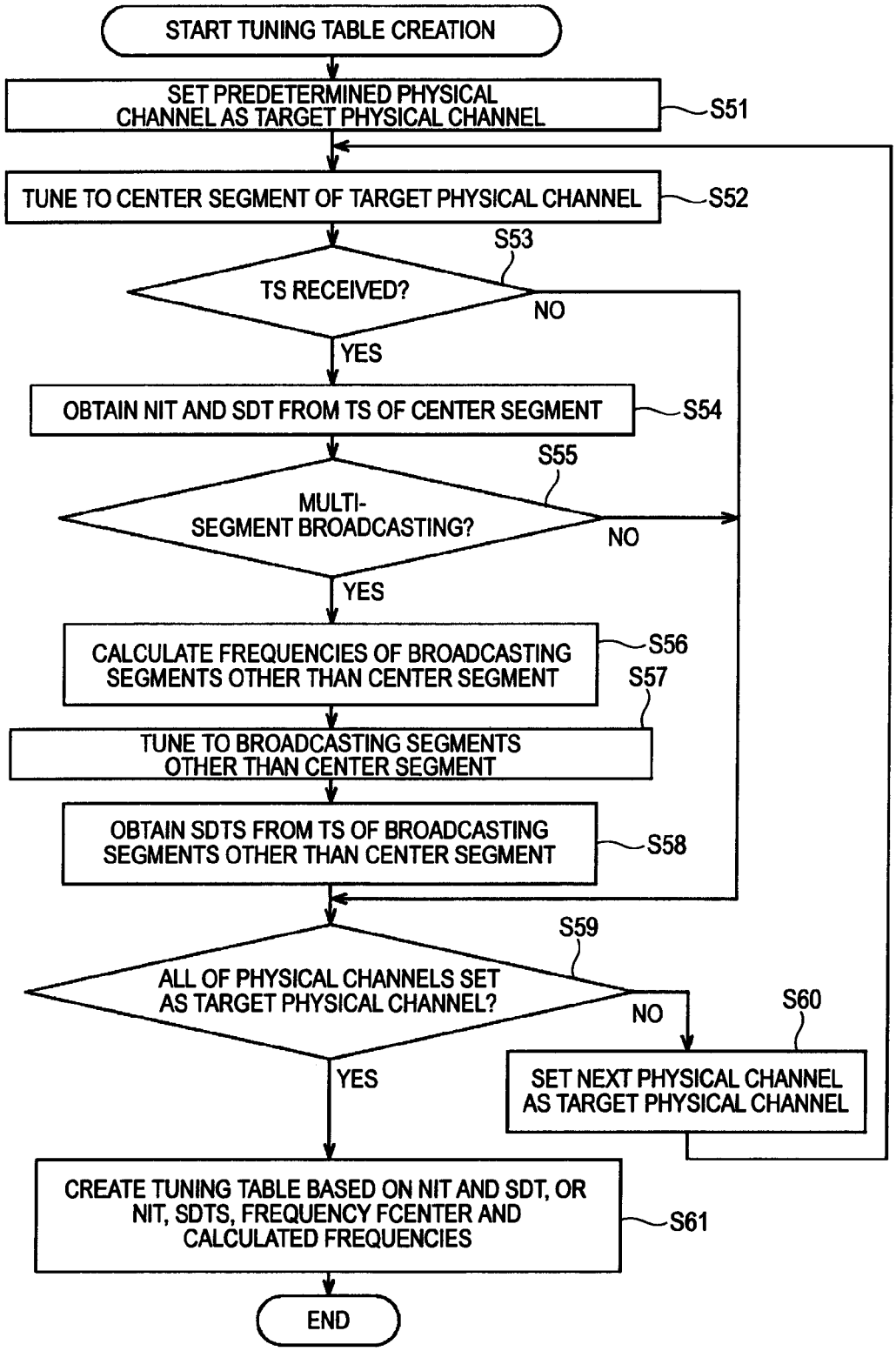
FIG. 24 A flowchart of tuning table creation by the receiving terminal.

FIG. 24 is a flowchart of tuning table creation by the receiving terminal 33. This tuning table creation is started, for example, when a user indicates to obtain a tuning table.

In step S51, the controller 80 sets a predetermined physical channel (for example, a physical channel with the lowest frequency) as target physical channel to be processed. Then, the controller 80 provides the frequency of the center segment of the target physical channel to the tuner 72 as tuning information.

In step S52, the tuner 72 tunes to the center segment of the target physical channel based on the tuning information from the controller 80.

In step S53, the tuner 72 determines whether the TS of the center segment of the target physical channel has been received or not. If determined that it has been received, the process proceeds to step S54.

In step S54, the demultiplexer 73 demultiplexes the TS of the center segment of the target physical channel received by the tuner 72 to obtain an NIT and SDT. Then, the demultiplexer 73 provides the NIT and SDT to the controller 80.

In step S55, the controller 80 determines whether the received TS is the TS of the center segment of the multi-segment broadcasting or not, or whether the NIT provided from the demultiplexer 73 contains a multi-segment information descriptor or not.

If determined in step S55 that the received TS is the TS of the center segment of the multi-segment broadcasting, the process proceeds to step S56. In step S56, the controller 80 calculates the frequencies of broadcasting segments other than the center segment based on the mode information and multi-segment layout information of the multi-segment information descriptor contained in the NIT of the center segment and the frequency fcenter. Then, the controller 80 provides the calculated frequencies as tuning information to the tuner 72 in the order based on the connection information.

In step S57, the tuner 72 tunes to the broadcasting segments other than the center segment of the target physical channel based on the tuning information from the controller 80. In step S58, the demultiplexer 73 demultiplexes the TS of the broadcasting segments other than the center segment of the target physical channel received by the tuner 72 to obtain SDTs. Then, the demultiplexer 73 provides the SDTs to the controller 80 and the process proceeds to step S59.

On the other hand, if determined in step S53 that the TS of the center segment of the target physical channel has not been received, or if determined in step S55 that the TS received in step S55 is not the TS of the center segment of the multi-segment broadcasting, the process proceeds to step S59.

In step S59, the controller 80 determines whether all of the physical channels have been set as target physical channel or not. If determined in step S59 that not all of the physical channels have been set as target physical channel, in step S60, the controller 80 sets a next physical channel (for example, a physical channel with the second lowest frequency) as target physical channel, then the process returns to step S52. Then, the process of steps S52 to S60 is repeated until all of the physical channels are set as target physical channel.

On the other hand, if determined in step S59 that all of the physical channels are set as target physical channel, the process proceeds to step S61.

In step S61, the controller 80 creates a tuning table based on the NIT and SDT of the One-Seg broadcasting, or the NIT of the One-Seg rebroadcastings of the center segment, the SDTs of the One-Seg rebroadcastings of the broadcasting segments, the frequency fcenter and the frequencies calculated in the step S56. Then, the controller 80 stores the created tuning table in a built-in memory, then the process ends.

As above, the One-Seg retransmitting station 32 generates the NIT of the center segment of the One-Seg rebroadcasting including the NIT of the One-Seg broadcasting and the multi-segment information descriptor, then transmits the NIT in the center segment of the One-Seg rebroadcasting. Then, the receiving terminal 33 receives the TS of the center segment of each physical channel and, according to the multi-segment information descriptor contained in the TS, recognizes whether the center segment is a segment of the multi-segment broadcasting or not, to control tuning. This allows the tuning information of all of the One-Seg rebroadcastings to be recognized.

Note that, in the above description, service names based on the SDT are to be registered on the tuning table, but service names may not be registered on the tuning table. In this case, the broadcasting segments other than the center segment need not be tuned to.

Furthermore, the signal converter 43 of the One-Seg retransmitting station 32 may not only place a multi-segment information descriptor or the like in the NIT transmitted in the center segment, but also change the frequency of the One-Seg broadcasting given in the NIT into the frequency of the center segment. In this case, the frequency given in the NIT of the center segment of the One-Seg rebroadcasting can be used as the frequency fcenter.

Second Embodiment

Configuration Example of Second Embodiment of Transmitting/Receiving System

Figure 25:
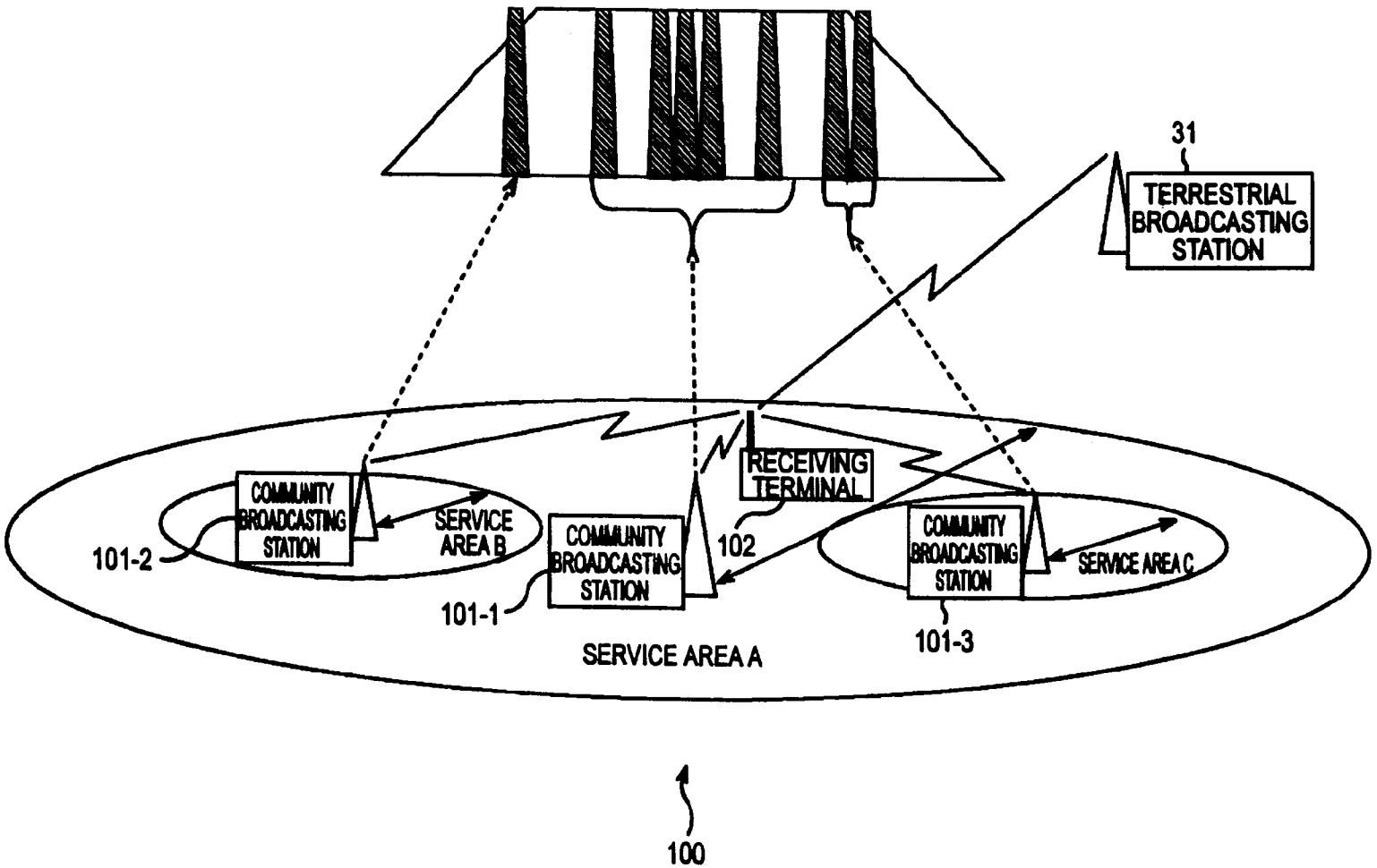
FIG. 25 A configuration example of a second embodiment of a transmitting/receiving system to which the invention is applied.

FIG. 25 shows a configuration example of a second embodiment of a transmitting/receiving system to which the invention is applied.

The transmitting/receiving system 100 in FIG. 25 includes a terrestrial broadcasting station 31, community broadcasting stations 101-1 to 101-3 and a receiving terminal 102. Note that the same components as those shown in FIG. 4 are denoted by the same numerals and will not be repeatedly described.

The transmitting/receiving system 100 in FIG. 25 transmits a multi-channel community broadcasting, not a One-Seg rebroadcasting, in a multi-segment broadcasting using an unused channel of the terrestrial digital broadcasting wave.

Note that the multi-channel community broadcasting is a one-segment broadcasting performed in variety using a plurality of logical channels in a limited area. An example of the multi-channel community broadcasting may be a broadcasting relating a theme park receivable only within the theme park. Hereinafter, the multi-channel community broadcasting is simply referred to as community broadcasting.

The community broadcasting station 101-1 of the transmitting/receiving system 100 transmits a community broadcasting receivable only within a service area A as a multi-segment broadcasting using an unused channel of the terrestrial digital broadcasting wave.

On the other hand, the community broadcasting station 101-2 transmits a community broadcasting receivable only within a service area B as a multi-segment broadcasting using an unused channel of the terrestrial digital broadcasting wave. Furthermore, the community broadcasting station 101-3 transmits a community broadcasting receivable only within a service area C as a multi-segment broadcasting using an unused channel of the terrestrial digital broadcasting wave.

In the example in FIG. 25, the service area A includes the service areas B and C. Specifically, the community broadcasting station 101-1 is a central station having a predetermined area as the service area A, and the community broadcasting stations 101-2 and 101-3 are local stations having a building or amusement park within the area as the service areas B and C, respectively.

Accordingly, in this case, the community broadcasting of the central station having a large receivable area (community broadcasting station 101-1) is obviously more important than the community broadcasting of the local stations (community broadcasting stations 101-2 and 101-3).

Thus, in the transmitting/receiving system 100, the community broadcasting of the community broadcasting station 101-1 as the central station is allocated to the center segment, allowing the more important community broadcasting to be more reliably received by the receiving terminal 102.

Note that, when the importance of community broadcastings is not so obvious as that for the transmitting/receiving system 100 in FIG. 25, the band allocation of community broadcastings within an unused channel need not be obviously defined.

The receiving terminal 102 is a mobile terminal capable of receiving a One-Seg broadcasting and community broadcasting. So, when a user having the receiving terminal 102 is in the service area A as shown in FIG. 25, the receiving terminal 102 can receive a One-Seg broadcasting and the community broadcastings from the community broadcasting stations 101-1 to 101-3.

Note that, hereinafter, the community broadcasting stations 101-1 to 101-3 are collectively referred to as a community broadcasting station 101 when they need not be individually distinguished. Now, community broadcasting is described as an example of multi-segment broadcasting.

[Detailed Configuration Example of Community Broadcasting Station]

Figure 26:
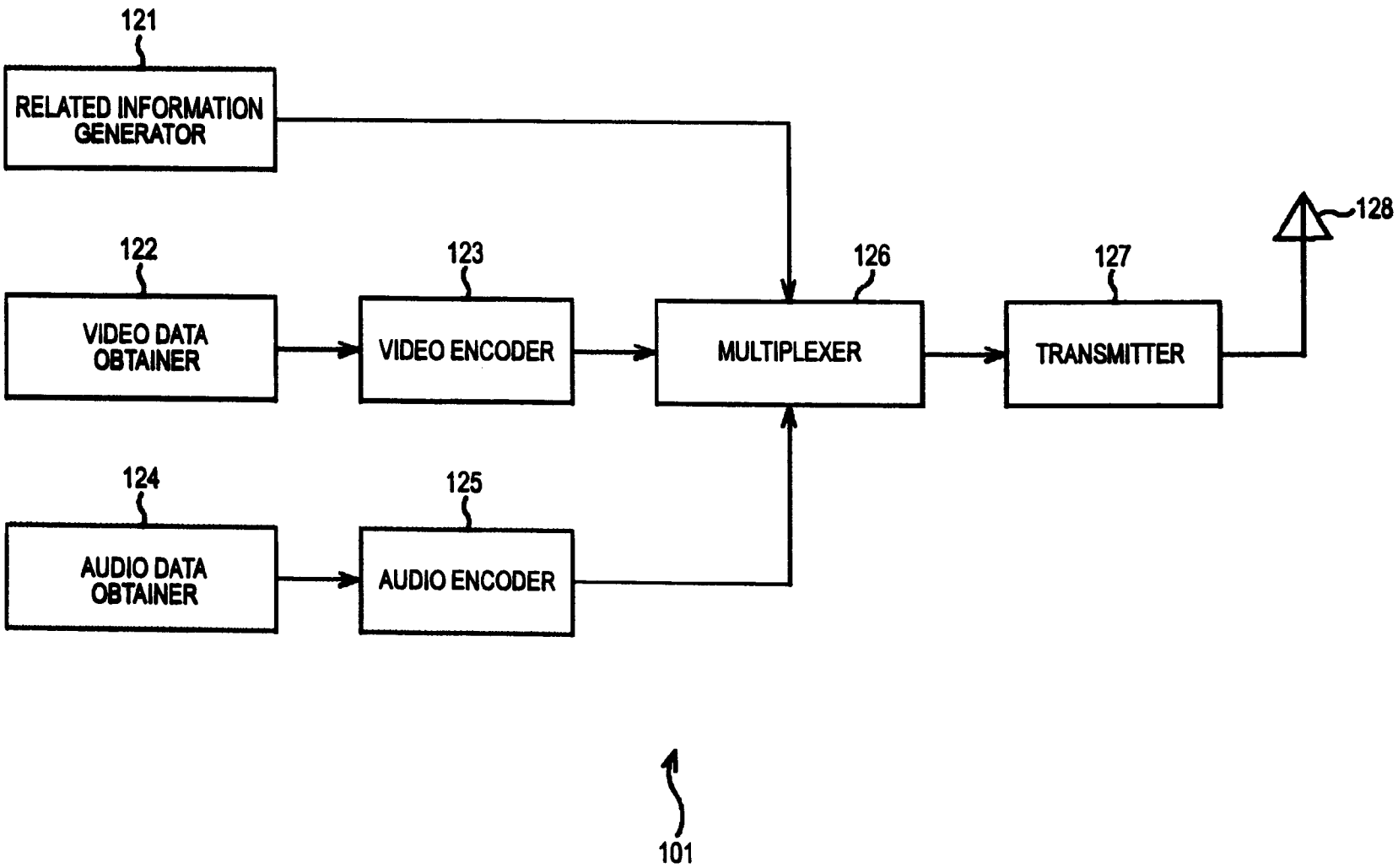
FIG. 26 A block diagram showing a detailed configuration example of a community broadcasting station.

FIG. 26 is a block diagram showing a detailed configuration example of the community broadcasting station 101.

The community broadcasting station 101 in FIG. 26 includes a related information generator 121, a video data obtainer 122, a video encoder 123, an audio data obtainer 124, an audio encoder 125, a multiplexer 126, a transmitter 127 and an antenna 128.

The related information generator 121 generates PSI including an NIT, an SDT and the like of the community broadcasting, display control information and the like as related information, then provides the related information to the multiplexer 126. Note that the NIT of the community broadcasting transmitted in the center segment contains a multi-segment information descriptor.

The video data obtainer 122 obtains video data of the community broadcasting from a built-in HDD (Hard Disk Drive) not shown, an external server or the like, and provides the video data to the video encoder 123.

The video encoder 123 encodes the video data provided from the video data obtainer 122 according to an encoding scheme, such as MPEG2 (Moving Picture Experts Group phase 2), and provides the encoded video data to the multiplexer 126.

The audio data obtainer 124 obtains audio data of the community broadcasting from a built-in HDD not shown, an external server or the like, and provides the audio data to the audio encoder 125.

The audio encoder 125 encodes the audio data provided from the audio data obtainer 124 according to an encoding scheme, such as MPEG2, and provides the encoded audio data to the multiplexer 126.

The multiplexer 126 multiplexes the related information from the related information generator 121, the video data from the video encoder 123 and the audio data from the audio encoder 125 to generate a TS, and provides the TS to the transmitter 127.

The transmitter 127 transmits the TS provided from the multiplexer 126, in a predetermined segment via the antenna 128.

[Description of Process of Community Broadcasting Station]

Figure 27:
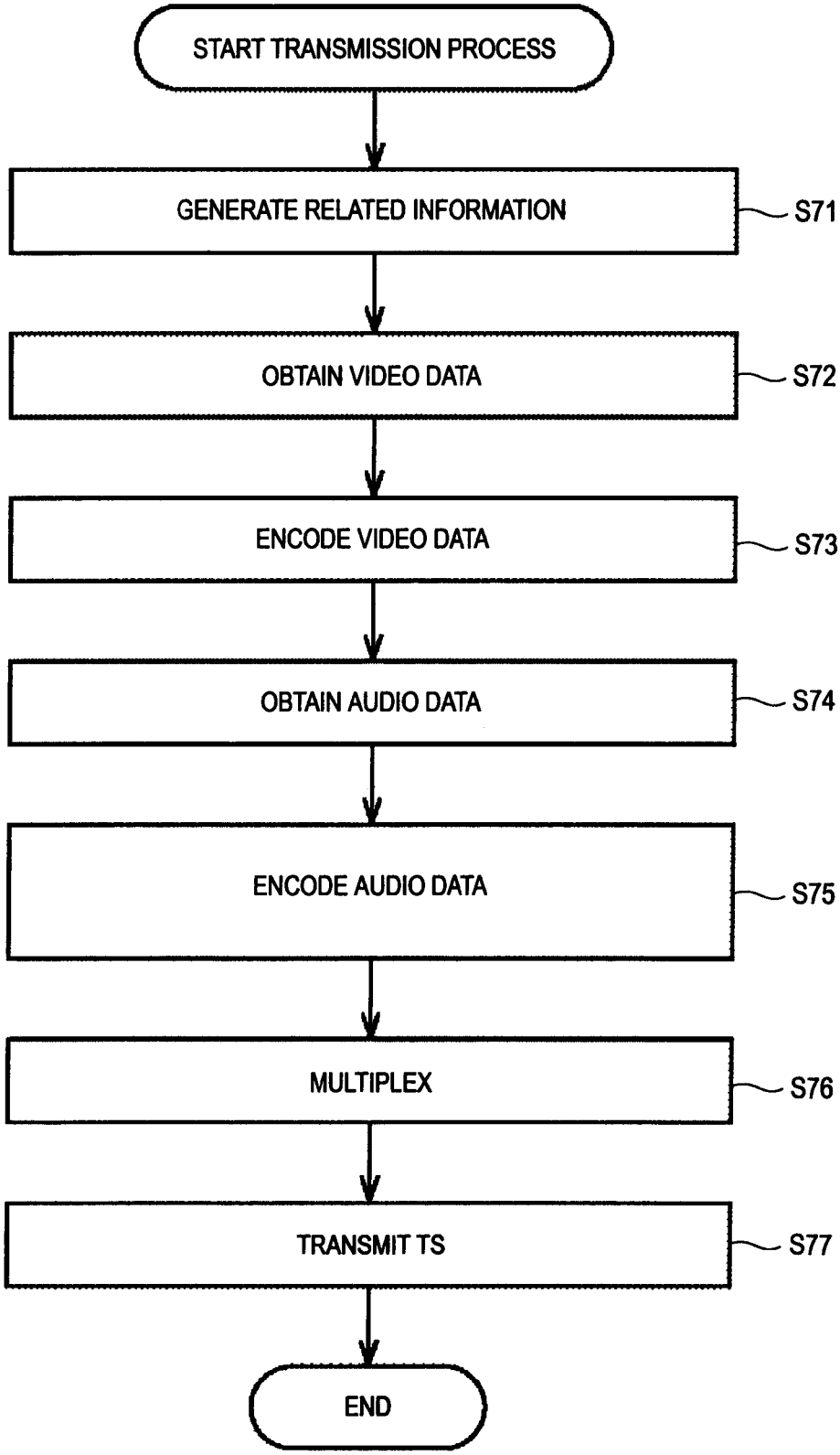
FIG. 27 A flowchart describing the transmission process of the community broadcasting station.

FIG. 27 is a flowchart describing the transmission process of the community broadcasting station 101.

In step S71, the related information generator 121 generates PSI of the community broadcasting, display control information and the like as related information, then provides the related information to the multiplexer 126.

In step S72, the video data obtainer 122 obtains video data of the community broadcasting from a built-in HDD not shown, an external server or the like, and provides the video data to the video encoder 123.

In step S73, the video encoder 123 encodes the video data provided from the video data obtainer 122 according to an encoding scheme, such as MPEG2, and provides the encoded video data to the multiplexer 126.

In step S74, the audio data obtainer 124 obtains audio data of the community broadcasting from a built-in HDD not shown, an external server or the like, and provides the audio data to the audio encoder 125.

In step S75, the audio encoder 125 encodes the audio data provided from the audio data obtainer 124 according to an encoding scheme, such as MPEG2, and provides the encoded audio data to the multiplexer 126.

In step S76, the multiplexer 126 multiplexes the related information from the related information generator 121, the video data from the video encoder 123 and the audio data from the audio encoder 125 to generate a TS.

Specifically, the multiplexer 126 generates a TS containing an NIT including a multi-segment information descriptor, as the TS of the center segment. Also, the multiplexer 126 generates a TS containing an NIT not including a multi-segment information descriptor, as the TS of a non-center segment. Then, the multiplexer 126 provides the generated TS to the transmitter 127.

In step S77, the transmitter 127 transmits the TS provided from the multiplexer 126, in a predetermined segment via the antenna 128, then the process ends.

[Detailed Configuration Example of Receiving Terminal]

Figure 28:
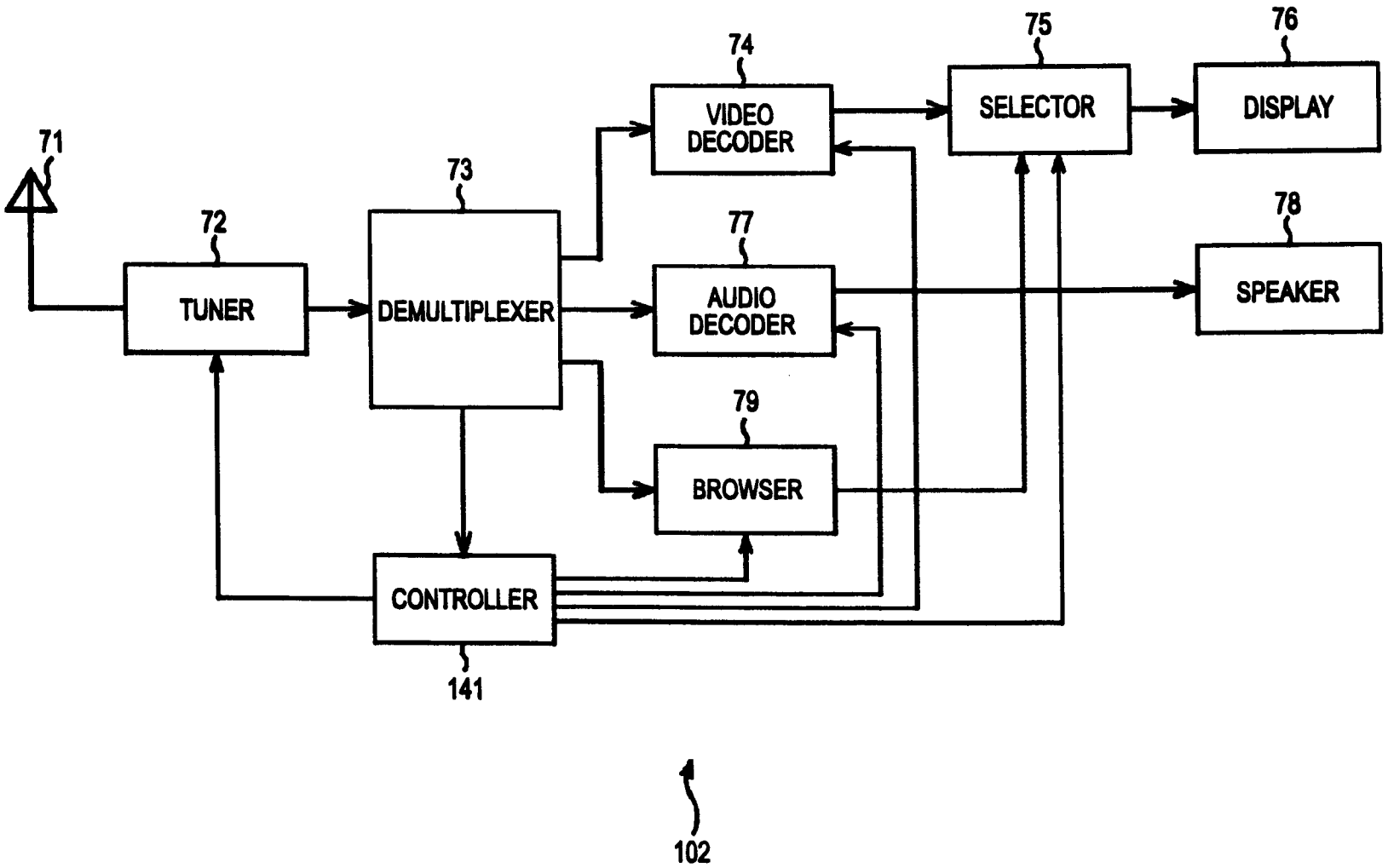
FIG. 28 A block diagram showing a detailed configuration example of the receiving terminal in FIG. 25.

FIG. 28 is a block diagram showing a detailed configuration example of the receiving terminal 102 in FIG. 25.

In FIG. 28, the receiving terminal 102 includes an antenna 71, a tuner 72, a demultiplexer 73, a video decoder 74, a selector 75, a display 76, an audio decoder 77, a speaker 78, a browser 79 and a controller 141. Note that the same components as those shown in FIG. 20 are denoted by the same numerals and will not be repeatedly described.

As with the controller 80 in FIG. 20, the controller 141 provides, in turn, tuning information of the center segments of the physical channels of the terrestrial digital broadcasting wave to the tuner 72. Also, the controller 141 calculates the frequencies of the broadcasting segments other than the center segment based on the NIT of the center segment of the community broadcasting. Then, the controller 141 provides the calculated frequencies as tuning information to the tuner 72 in the order based on the connection information.

Furthermore, the controller 141 generates a tuning table based on the NIT and SDT of the One-Seg broadcasting provided from the demultiplexer 73, or the NIT and SDT of the center segment of the community broadcasting, and the calculated frequencies, then stores the tuning table in a built-in memory (not shown).

Also, as with the controller 80, in response to an indication from a user, the controller 141 provides service names registered on the tuning table to the browser 79 to cause the service names to be shown on the display 76. The user sees the service names shown on the display 76 to indicate the selection of the service name of a broadcasting service to view. As with the controller 80, based on this selection indication, the controller 141 reads from the tuning table tuning information corresponding to the name of the service to view, and provides the tuning information to the tuner 72.

Also, as with the controller 80, the controller 141 controls the video decoder 74, the selector 75, the audio decoder 77 and the browser 79 based on the various information in the PSI provided from the demultiplexer 73.

[Method for Creating Tuning Table]

Figure 29:
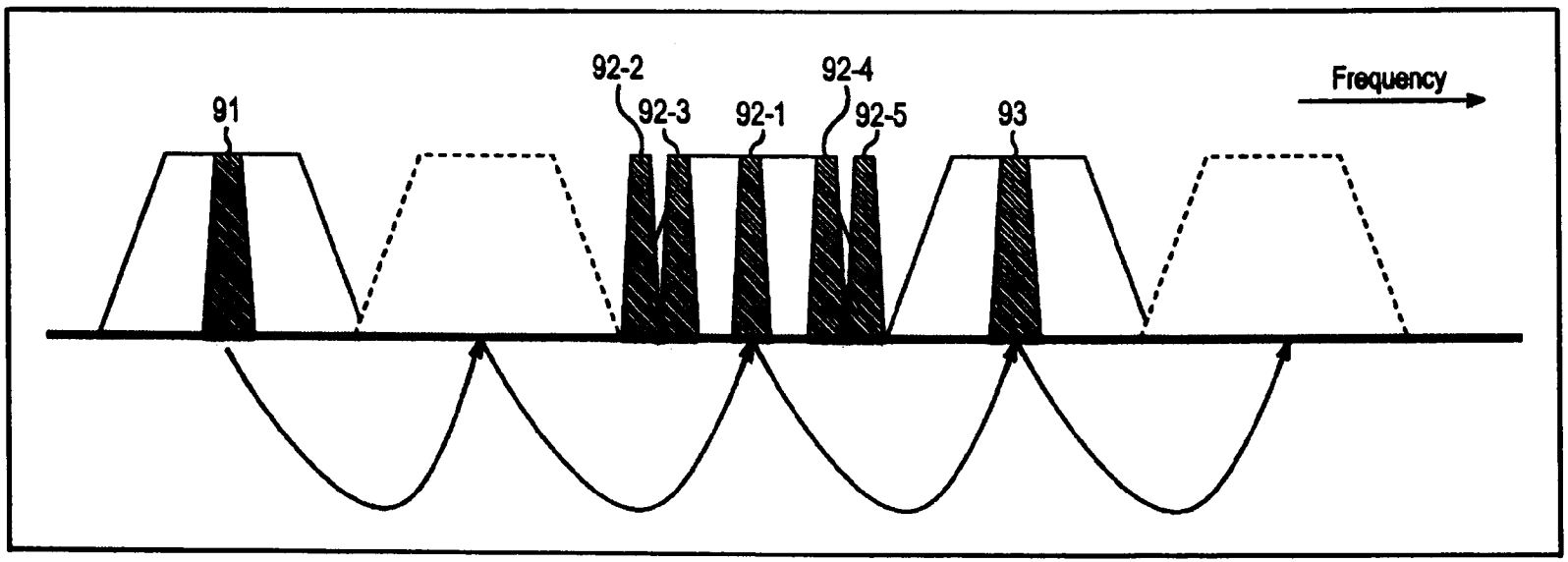
FIG. 29 An illustration of a method for creating a tuning table in the receiving terminal in FIG. 25.

FIG. 29 illustrates a method for creating a tuning table in the receiving terminal 102.

As shown in FIG. 29, as with the receiving terminal 33, the receiving terminal 102 scans the center segments of the physical channels of the terrestrial digital broadcasting wave in the order from low to high frequencies.

Then, the TSs of the center segments 91 and 93 of physical channels to which the terrestrial digital broadcasting is allocated are obtained, then the NIT and SDT of One-Seg broadcastings to be broadcast in the center segments 91 and 93 are obtained from the TSs. Also, the TS of the center segments 92-1 of a physical channel to which the community broadcasting is allocated is obtained, then the NIT and SDT of the community broadcasting to be broadcast in the center segments 92-1 are obtained from the TS.

Then, the frequencies of the broadcasting segments 92-2 to 92_5 other than the center segment 92-1 are calculated based on the multi-segment layout information and mode information of the multi-segment information descriptor contained in the NIT of the center segment 92-1 and the frequency fcenter. Then, the tuning table is created based on the NIT and SDT of the One-Seg broadcasting, or the NIT and SDT of the community broadcasting of the center segment, and the calculated frequencies.

[Configuration Example of Tuning Table]

Figure 30:
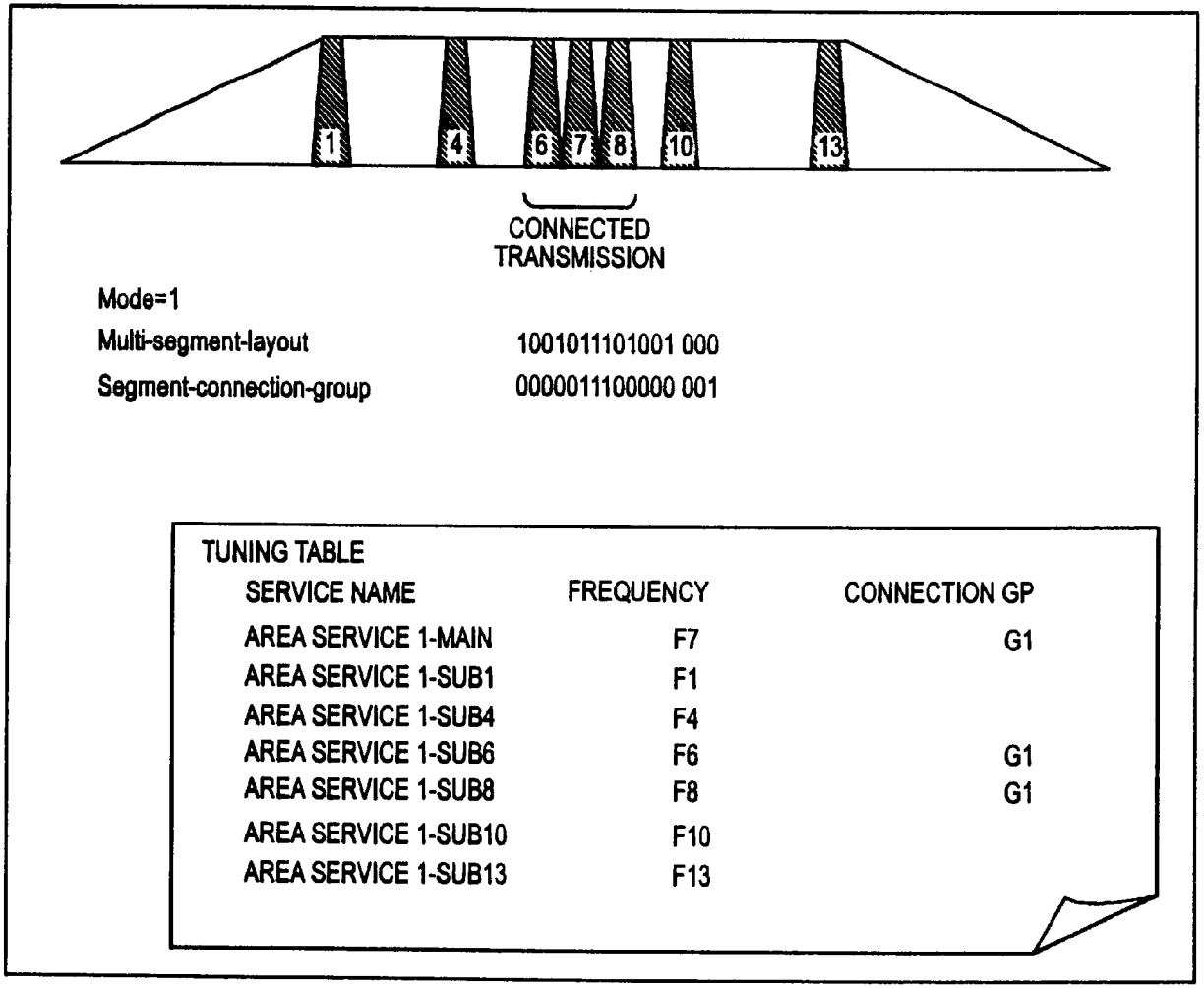
FIG. 30 An example of the tuning table created by the receiving terminal in FIG. 25.

FIG. 30 shows an example of the tuning table created by the receiving terminal 102.

In the example in FIG. 30, the first, fourth, sixth to eighth, tenth and thirteenth segments of a physical channel to which the community broadcastings are allocated are set to broadcasting segments, and the mode information is set to mode 1. Note that, as shown in FIG. 12, mode 1 indicates that the segment interval is $\Delta f1$ and one physical channel in mode 1 includes 13 segments.

In this case, first, the seventh segment that is the center segment is tuned to and a multi-segment information descriptor is recognized. Then, the frequencies of broadcasting segments other than the center segment are calculated based on the mode information and multi-segment layout information of this multi-segment information descriptor and the frequency fcenter contained in the NIT of the center segment. Then, on the tuning table, service names related to the service names contained in the SDT of the center segment are registered in association with the frequency fcenter and the calculated frequencies.

In the example in FIG. 30, a service name "area service 1-main" related to the service name "area service 1" contained in the SDT of the center segment is registered as a service name of the center segment in association with the frequency fcenter. Also, a service name "area service 1-sub1" and the like related to the service name "area service 1" are registered as a service name of the broadcasting segments other than the center segment in association with the calculated frequencies.

Furthermore, on the tuning table, the number of the connection group of each broadcasting segment is also registered based on the connection information of the multi-segment information descriptor. In the example in FIG. 30, the TS of the seventh segment that is the center segment and the TSs of the sixth and eighth segments are transmitted from the same community broadcasting station 101, and the same connection group number "G1" is registered for the sixth to eighth segments.

[Description of Process of Receiving Terminal]

Figure 31:
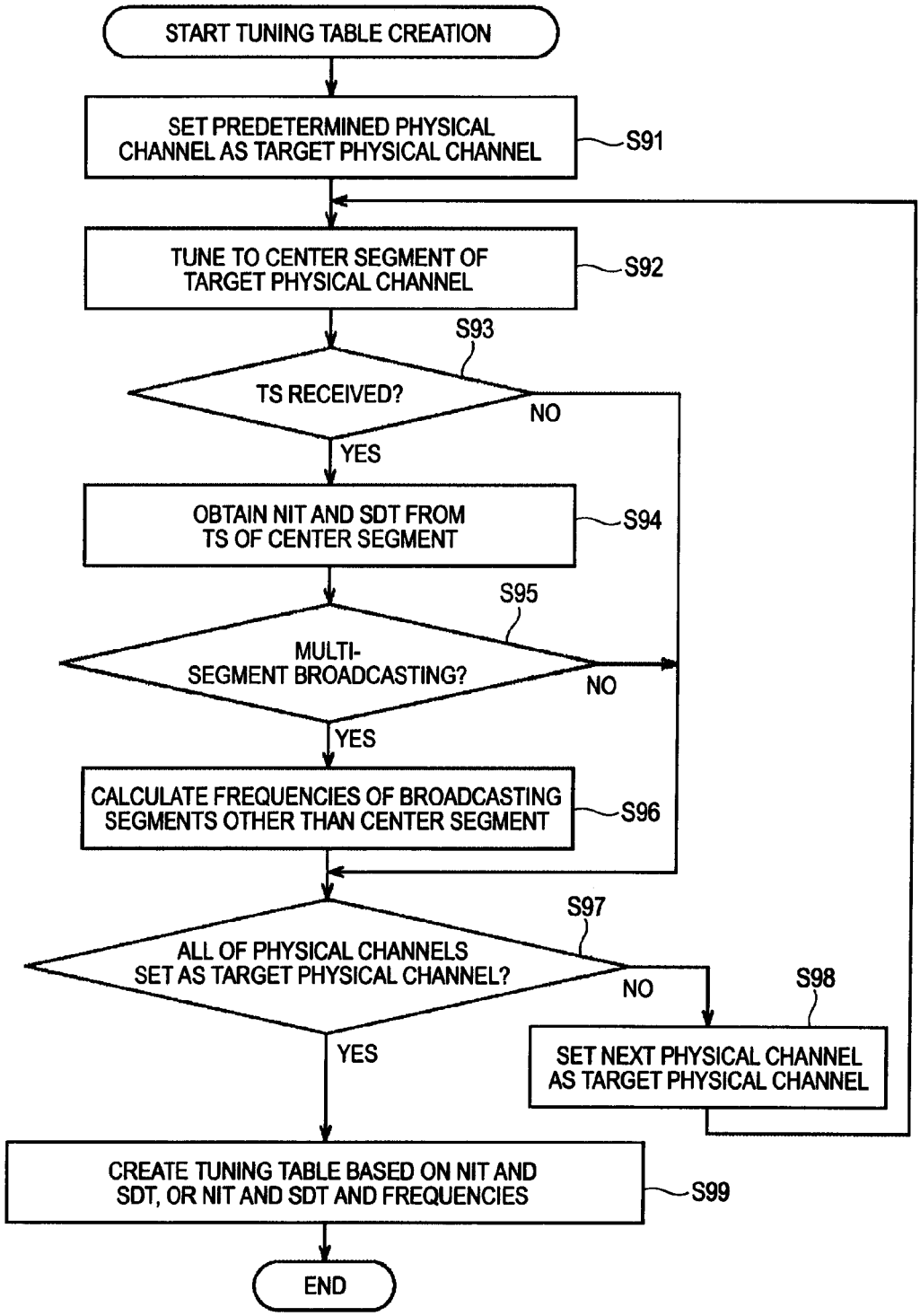
FIG. 31 A flowchart of tuning table creation by the receiving terminal in FIG. 25.

FIG. 31 is a flowchart of tuning table creation by the receiving terminal 102. This tuning table creation is started, for example, when a user indicates to obtain a tuning table.

The process of steps S91 to S98 is similar to the process of steps S51 to S56, S59 and S60 in FIG. 24, and will not be repeatedly described.

In step S99, the controller 141 creates the tuning table based on the NIT and SDT of the One-Seg broadcasting, or the NIT and SDT of the community broadcasting of the center segment, and the frequencies calculated in step S96. Then, the controller 80 stores the created tuning table in a built-in memory, then the process ends.

As above, the community broadcasting station 101 generates the NIT of the center segment of the community broadcasting including the NIT of the community broadcasting and the multi-segment information descriptor, then transmits the NIT in the center segment of the community broadcasting. Then, the receiving terminal 102 receives the TS of the center segment of each physical channel and, according to the multi-segment information descriptor contained in the TS, recognizes whether the center segment is a segment of the multi-segment broadcasting or not, to control tuning. This allows the tuning information of all of the community broadcastings to be recognized.

Note that, also in the transmitting/receiving system 100, the receiving terminal 102 may tune to a broadcasting segment other than the center segment of the community broadcasting to obtain an SDT and register a correct service name on the tuning table based on the SDT.

Accordingly, when the receiving terminal 102 tunes to a broadcasting segment other than the center segment, the receiving terminal 102 can recognize an actually receivable broadcasting segment among the broadcasting segments recognized from the NIT of the center segment.

For example, in FIG. 25, the receiving terminal 102 recognizes, from the NIT of the center segment, all of the segments used for transmission by the community broadcasting stations 101-1 to 101-3 as broadcasting segment. However, when the receiving terminal 102 is in the service area B, the receiving terminal 102 cannot receive the community broadcastings of the community broadcasting stations 101-1 and 101-3. So, even when the receiving terminal 102 tunes to a broadcasting segment other than the center segment, the TSs of the community broadcastings of the community broadcasting stations 101-1 and 101-3 are not received, and only an SDT of the community broadcasting of the community broadcasting station 101-2 that is actually receivable are obtained.

Thus, in this case, the receiving terminal 102 registers on the tuning table a flag indicating whether receivable or not, for each community broadcasting, and does not show a service name of a non-receivable community broadcasting on the display 76. Accordingly, it can be avoided that, when a user select a service name shown on the display 76, the community broadcasting corresponding to the service name is not shown.

Also, when the bitmap of the multi-segment layout information is not contained in the NIT of the center segment of the community broadcasting, the receiving terminal 102 cannot recognize a broadcasting segment and tunes to not only the center segment but also all of the non-center segments. This allows the receiving terminal 102 to recognize the tuning information of the broadcasting segments other than the center segment.

Also, in the above-described transmitting/receiving system 30 (100), one of the One-Seg rebroadcasting and the community broadcasting is performed in the multi-segment broadcasting, but both of them may be performed in the multi-segment broadcasting.

Also, in the above-described transmitting/receiving system 30 (100), the NIT of the One-Seg rebroadcasting or community broadcasting may be obtained to use for registering information, such as a service ID, on the tuning table.

According to the invention, the NIT defined in the existing terrestrial digital broadcasting with a multi-segment information descriptor appended thereto is transmitted as the NIT of the center segment of the multi-segment broadcasting, which ensures the multi-segment broadcasting in conformity with the methodology of the existing terrestrial digital broadcasting, ensuring interoperability.

Also, the receiving terminal 33 (102) can be embodied by adding to the conventional receiving terminal 95 the function of recognizing a multi-segment information descriptor of the NIT of the center segment of the multi-segment broadcasting, the function of creating a tuning table based on the multi-segment information descriptor, and the like. Thus, according to the receiving terminal 33 (102), the increase in cost to enable the multi-segment broadcasting may be limited.

A series of above-described process by the One-Seg retransmitting station 32, the receiving terminal 33, the community broadcasting station 101 and the receiving terminal 102 may be performed by hardware or by software. In order to perform the series of process by software, a program for configuring the software is installed in a computer. The computer may be a computer with dedicated hardware built in or a computer in which various programs can be installed to perform various functions, for example, a general-purpose personal computer.

Figure 32:
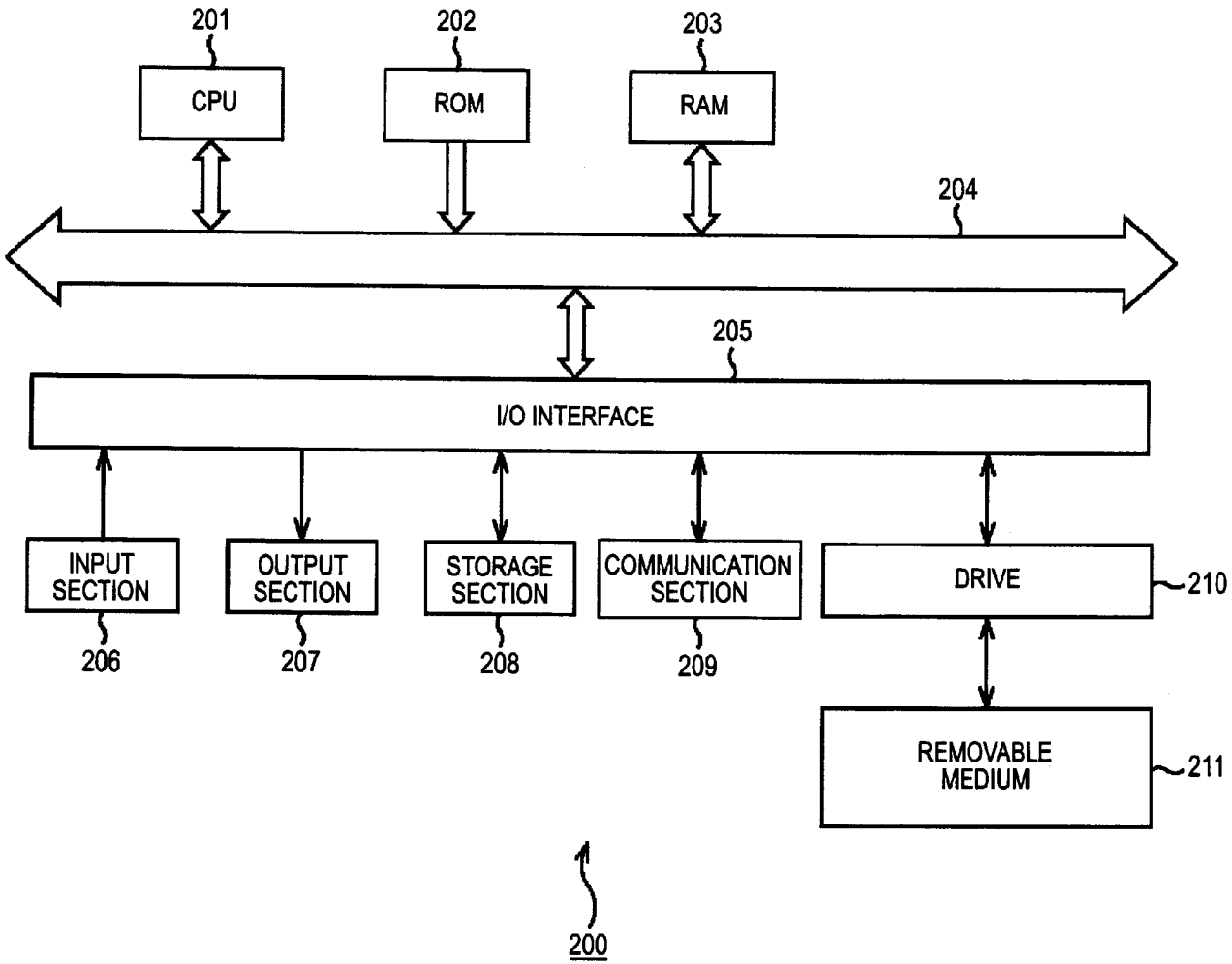
FIG. 32 A block diagram showing a configuration example of hardware of a personal computer.

FIG. 32 is a block diagram showing a configuration example of hardware of a personal computer that performs the above-described series of process by program.

A personal computer 200 includes a CPU (Central Processing Unit) 201, a ROM (Read Only Memory) 202 and a RAM (Random Access Memory) 203, which are connected to one another by a bus 204.

Furthermore, an I/O interface 205 is connected to the bus 204. To the I/O interface 205, an input section 206, an output section 207, a storage section 208, a communication section 209 and a drive 210 are connected.

The input section 206 includes a keyboard, a mouse, a microphone and the like. The output section 207 includes a display, a speaker and the like. The storage section 208 includes a hard disk, a non-volatile memory and the like. The communication section 209 includes a network interface. The drive 210 drives a removable medium 211, such as a magnetic disk, an optical disk, a magneto-optical disk or a semiconductor memory.

In the thus configured personal computer 200, the CPU 201, for example, loads a program stored in the storage section 208 to the RAM 203 via the I/O interface 205 and the bus 204 and executes the program to perform the above described series of process.

The program to be executed by the personal computer 200 (CPU 201) can be provided, for example, as a package medium or the like recorded on the removable medium 211. The program can also be provided through a wired or wireless transmission medium, such as a local area network, Internet and digital satellite broadcasting.

In the personal computer 200, the program can be installed in the storage section 208 via the I/O interface 205 by loading the removable medium 211 into the drive 210. The program can also be received by the communication section 209 through the wired or wireless transmission medium and installed in the storage section 208. Furthermore, the program can be preinstalled in the ROM 202 or the storage section 208.

Note that the program to be executed by the computer may be a program to perform the process chronologically in the order as described herein or may be a program to perform the process in parallel or at an appropriate time, e.g., when called.

As used herein, the term "system" refers to an apparatus as a whole including a plurality of devices.

Furthermore, an embodiment of the invention is not intended to be limited to the above-described embodiment, and various modifications may be implemented without departing from the scope and spirit of the invention.

DESCRIPTION OF REFERENCE NUMERALS AND SIGNS

32 One-Seg retransmitting station, 33 receiving terminal, 42-1 to 42-3 One-Seg tuner, 43-1 to 43-3 signal converter, 44 multi-segment transmitter, 72 tuner, 80 controller, 101 community broadcasting station, 102 receiving terminal, 121 related information generator, 127 transmitter, 141 controller

The invention claimed is:

1. A transmitting apparatus comprising:

generating means for generating representative tuning information including tuning information that is information on tuning to a representative segment of a multi-segment broadcasting and multi-segment information indicating that the representative segment is a segment of the multi-segment broadcasting; and transmitting means for transmitting the representative tuning information in the representative segment, wherein the representative segment is a center segment of a channel of the multi-segment broadcasting, wherein when the transmitting means transmits the representative tuning information in the center segment, the transmitting means transmits an associated transport stream having a Network Information Table (NIT) that is modified by appending the multi-segment information thereto, and wherein when another transport stream of a segment other than the center segment is transmitted, the another transport stream is transmitted without modification of an NIT provided therein.

2. The transmitting apparatus according to claim 1, wherein the representative tuning information includes layout information indicating the layout of a segment or segments used for the multi-segment broadcasting among a plurality of segments included in a physical channel including the representative segment.

3. The transmitting apparatus according to claim 2, wherein the representative tuning information includes mode information indicating an interval of the segments.

4. The transmitting apparatus according to claim 1, further comprising:

receiving means for receiving One-Seg data that is video data or audio data and tuning information of a terrestrial digital broadcasting, transmitted in one predetermined segment of the terrestrial digital broadcasting, wherein the generating means uses the tuning information received by the receiving means, corresponding to representative One-Seg data that is One-Seg data retransmitted in the representative segment, as tuning information of the representative segment to generate the representative tuning information including the tuning information of the representative segment, the multi-segment information and retransmission information indicating the layout of a segment or segments used to retransmit the One-Seg data, and wherein the transmitting means transmits the representative One-Seg data and the representative tuning information in the representative segment and transmits One-Seg data other than the representative One-Seg data and tuning information of the terrestrial digital broadcasting corresponding to the One-Seg data in a segment or segments other than the representative segment.

5. The transmitting apparatus according to claim 4, wherein the generating means changes a frequency of the one predetermined segment included in the tuning information of the terrestrial digital broadcasting corresponding to the representative One-Seg data into a frequency of the representative segment to generate tuning information of the representative segment and generate the representative tuning information including the tuning information of the representative segment, the multi-segment information and the retransmission information.

6. The transmitting apparatus according to claim 1, wherein the generating means also generates tuning information of a non-representative segment or segments that are the segment(s) other than the representative segment of the multi-segment broadcasting, wherein the transmitting means transmits the representative tuning information in the representative segment and transmits the tuning information of the non-representative segment(s) in the non-representative segment(s), and wherein the representative tuning information includes connection information indicating the layout of the representative segment and the non-representative segment(s) used for transmission by the transmitting means as the layout of a segment or segments used for transmission by the same transmitting apparatus.

7. A transmitting method comprising:

generating step in which a transmitting apparatus generates representative tuning information including tuning information that is information on tuning to a representative segment of a multi-segment broadcasting and multi-segment information indicating that the representative segment is a segment of the multi-segment broadcasting; and transmitting step in which the transmitting apparatus transmits the representative tuning information in the representative segment, wherein the representative segment is a center segment of a channel of the multi-segment broadcasting, wherein when the transmitting apparatus transmits the representative tuning information in the center segment, the transmitting apparatus transmits an associated transport stream having a Network Information Table (NIT) that is modified by appending the multi-segment information thereto, and wherein when another transport stream of a segment other than the center segment is transmitted, the another transport stream is transmitted without modification of an NIT provided therein.

8. A receiving apparatus comprising:

receiving means for receiving representative tuning information including tuning information that is information on tuning to a representative segment and multi-segment information indicating that the representative segment is a segment of a multi-segment broadcasting, transmitted in the representative segment of the multi-segment broadcasting; and controlling means for controlling tuning depending on the multi-segment information included in the representative tuning information received by the receiving means, wherein the representative segment is a center segment of a channel of the multi-segment broadcasting, wherein the representative tuning information that is transmitted in the center segment and received by the receiving means is provided within a transport stream, the transport stream comprising a Network Information Table (NIT) that was modified prior to transmission by appending the multi-segment information thereto, and wherein the receiving means further receives another transport stream of a segment other than the center segment, the another transport stream having been transmitted without modification of an NIT provided therein.

9. The receiving apparatus according to claim 8, wherein the representative tuning information includes layout information indicating the layout of a segment or segments used for the multi-segment broadcasting among a plurality of segments included in a physical channel, and wherein the controlling means controls tuning of a segment or segments used for the multi-segment broadcasting based on the multi-segment information and the layout information.

10. The receiving apparatus according to claim 9, wherein the receiving means also tunes to a segment or segments used for the multi-segment broadcasting and receives information on broadcasting data transmitted in the segment(s) according to the control of the controlling means.

11. The receiving apparatus according to claim 9, wherein the representative tuning information includes mode information indicating a interval of the segments, and wherein the controlling means controls tuning of a segment or segments used for the multi-segment broadcasting based on the multi-segment information, the layout information and the mode information.

12. The receiving apparatus according to claim 11, wherein the controlling means determines a frequency of a segment or segments used for the multi-segment broadcasting based on the multi-segment information, the layout information, the mode information and a frequency of the representative segment and controls tuning based on the frequency of the segment(s).

13. The receiving apparatus according to claim 11, wherein the controlling means determines a frequency of a segment or segments used for the multi-segment broadcasting based on the multi-segment information, the layout information, the mode information and a frequency of the representative segment included in the tuning information of the representative segment and controls tuning based on the frequency of the segment(s).

14. The receiving apparatus according to claim 8, wherein the receiving means receives the representative tuning information and One-Seg data that is video data or audio data already having been transmitted in one predetermined segment of a terrestrial digital broadcasting, transmitted in the representative segment, and wherein the representative tuning information includes representative One-Seg data that is One-Seg data retransmitted in the representative segment as well as the tuning information of the terrestrial digital broadcasting already having been transmitted in the one predetermined segment of the terrestrial digital broadcasting, as the tuning information of the representative segment, and further includes retransmission information indicating the layout of a segment or segments used to retransmit the multi-segment information and the One-Seg data.

15. The receiving apparatus according to claim 14, wherein the representative tuning information includes the tuning information of the representative segment, the multi-segment information and the retransmission information generated by changing a frequency of the one predetermined segment included in the tuning information of the terrestrial digital broadcasting corresponding to the representative One-Seg data into a frequency of the representative segment.

16. The receiving apparatus according to claim 15, wherein the controlling means determines a frequency of a segment or segments other than the representative segment included in a physical channel based on the multi-segment information and the frequency of the representative segment included in the tuning information of the representative segment and controls tuning based on the frequency of the segment(s).

17. The receiving apparatus according to claim 8, wherein the representative tuning information includes connection information indicating the layout of a segment or segments used for transmission by the same transmitting apparatus among a plurality of segments included in a physical channel.

18. The receiving apparatus according to claim 17, wherein the controlling means also controls based on the connection information whether or not to perform synchronization in tuning.

19. The receiving apparatus according to claim 8, wherein the controlling means controls tuning to a segment or segments other than the center segment included in a physical channel including the representative segment based on the multi-segment information.

20. A receiving method comprising:

receiving step in which a receiving apparatus receives representative tuning information including tuning information that is information on tuning to a representative segment and multi-segment information indicating that the representative segment is a segment of a multi-segment broadcasting, transmitted in the representative segment of the multi-segment broadcasting; and controlling step in which the receiving apparatus controls tuning depending on the multi-segment information included in the representative tuning information received in the receiving step, wherein the representative segment is a center segment of a channel of the multi-segment broadcasting, wherein the representative tuning information that is transmitted in the center segment and received by the receiving apparatus is provided within a transport stream, the transport stream comprising a Network Information Table (NIT) that was modified prior to transmission by appending the multi-segment information thereto, and wherein the receiving apparatus further receives another transport stream of a segment other than the center segment, the another transport stream having been transmitted without modification of an NIT provided therein.

* * * * *